US011154166B2

(12) United States Patent
Osborne, Jr.

(10) Patent No.: US 11,154,166 B2
(45) Date of Patent: Oct. 26, 2021

(54) DISPENSER FOR ROLLED SHEET MATERIALS

(71) Applicant: Charles Agnew Osborne, Jr., Cumming, GA (US)

(72) Inventor: Charles Agnew Osborne, Jr., Cumming, GA (US)

( * ) Notice: Subject to any disclaimer, the term of this patent is extended or adjusted under 35 U.S.C. 154(b) by 77 days.

(21) Appl. No.: 16/593,004

(22) Filed: Oct. 4, 2019

(65) Prior Publication Data

US 2020/0029751 A1 Jan. 30, 2020

Related U.S. Application Data

(63) Continuation-in-part of application No. 15/988,579, filed on May 24, 2018.

(60) Provisional application No. 62/741,350, filed on Oct. 4, 2018.

(51) Int. Cl.

| | |
|---|---|
| ***A47K 10/38*** | (2006.01) |
| ***A47K 10/36*** | (2006.01) |
| ***A47K 10/34*** | (2006.01) |

(52) U.S. Cl.

CPC ..... *A47K 10/38* (2013.01); *A47K 10/34* (2013.01); *A47K 10/36* (2013.01)

(58) Field of Classification Search

CPC ..... A47K 10/38; A47K 10/36; A47K 10/34
See application file for complete search history.

(56) References Cited

U.S. PATENT DOCUMENTS

| | | | |
|---|---|---|---|
| 2,738,934 | A | 3/1956 | Dobkin |
| 3,317,150 | A | 5/1967 | Summersby |
| 3,554,456 | A | 1/1971 | Moore |
| 3,892,368 | A | 7/1975 | Ricards |
| 3,893,636 | A | 7/1975 | Wise et al. |
| 4,003,525 | A | 1/1977 | Podvin et al. |
| 4,071,200 | A | 1/1978 | Stone |
| 4,192,442 | A | 3/1980 | Bastian et al. |

(Continued)

FOREIGN PATENT DOCUMENTS

| | | | |
|---|---|---|---|
| CN | 104703521 | A | 6/2015 |
| EP | 0378550 | B1 | 9/1994 |
| WO | WO2018/126236 | A1 | 7/2018 |

OTHER PUBLICATIONS

International Search Report and the Written Opinion of the International Searching Authority for PCT/US2019/054641, dated Jan. 23, 2020.

(Continued)

*Primary Examiner* — Omar Flores Sanchez

(74) *Attorney, Agent, or Firm* — Womble Bond Dickinson (US) LLP

(57) ABSTRACT

In one aspect, the present disclosure is directed to a sheet material dispenser that includes a feed roller that is rotatable to facilitate dispensing of the sheet material from a discharge in a housing of the dispenser. The dispenser can have a cutting assembly that includes a cutting blade and at least one movable support coupled to cutting blade and that is actuated with rotation of the feed roller to cause movement of the cutting blade to at least partially cut, score, or perforate the sheet material during dispensing thereof. The dispenser also can have a biasing assembly coupled to the feed roller body to assist rotation of the feed roller body and/or movement of the cutting blade. Other aspects also are described.

15 Claims, 17 Drawing Sheets

(56) References Cited

U.S. PATENT DOCUMENTS

| | | | |
|---|---|---|---|
| 4,635,837 | A | 1/1987 | Granger |
| 4,690,344 | A | 9/1987 | Yokota |
| 4,712,461 | A | 12/1987 | Rasmussen |
| 4,738,176 | A | 4/1988 | Cassia |
| 4,790,490 | A | 12/1988 | Chakravorty |
| 4,846,035 | A | 7/1989 | Granger |
| 5,048,386 | A | 9/1991 | DeLuca et al. |
| 5,060,877 | A | 10/1991 | Bullivant |
| 5,441,210 | A | 8/1995 | Hinton |
| 5,452,832 | A | 9/1995 | Niada |
| 5,672,206 | A | 9/1997 | Gorman |
| 5,772,291 | A | 6/1998 | Bryd et al. |
| 5,848,609 | A | 12/1998 | Marchesseault et al. |
| 6,079,305 | A | 6/2000 | Bloch et al. |
| 6,098,917 | A | 8/2000 | Cruz |
| 6,179,243 | B1 | 1/2001 | Granger |
| 6,196,102 | B1 | 3/2001 | Granger |
| 6,199,792 | B1 | 3/2001 | Mivelaz |
| 6,283,139 | B1 | 9/2001 | Symonds |
| 6,314,850 | B1 | 11/2001 | Morand |
| 6,378,725 | B1 | 4/2002 | Granger |
| 6,408,727 | B1 | 6/2002 | Harris et al. |
| 6,411,920 | B1 | 6/2002 | McConnell |
| 6,532,979 | B1 | 3/2003 | Richter |
| 6,553,879 | B2 | 4/2003 | Morand |
| 6,691,945 | B2 | 2/2004 | Slezak |
| 6,695,246 | B1 | 2/2004 | Elliott et al. |
| 6,715,730 | B2 | 4/2004 | Ehr |
| 6,820,785 | B2 | 11/2004 | Kapiloff |
| 6,826,985 | B2 | 12/2004 | Broehl |
| 6,834,825 | B2 | 12/2004 | Pollastrelli et al. |
| 6,892,620 | B2 | 5/2005 | Kapiloff |
| 6,892,746 | B2 | 5/2005 | Ford |
| 6,895,848 | B1 | 5/2005 | Svensson |
| 6,903,654 | B2 | 6/2005 | Hansen et al. |
| 6,977,588 | B2 | 12/2005 | Schotz et al. |
| 6,988,689 | B2 | 1/2006 | Thomas et al. |
| 7,147,204 | B2 | 12/2006 | Hollingsworth |
| 7,213,782 | B2 | 5/2007 | Osborne et al. |
| 7,296,765 | B2 | 11/2007 | Rodrian |
| 7,357,348 | B2 | 4/2008 | Kananen |
| 7,370,824 | B1 | 5/2008 | Osborne |
| 7,373,864 | B2 | 5/2008 | Granger |
| 7,460,013 | B1 | 12/2008 | Osborne et al. |
| 7,527,215 | B1 | 5/2009 | Siddiqui |
| 7,571,670 | B2 | 8/2009 | Formon |
| 7,637,452 | B2 | 12/2009 | Kanbar et al. |
| 7,946,522 | B2 | 5/2011 | Lewis et al. |
| 7,987,756 | B2 | 8/2011 | Lewis et al. |
| 8,082,827 | B2 | 12/2011 | Friesen et al. |
| 8,146,471 | B2 | 4/2012 | Hansen et al. |
| 8,167,228 | B2 | 5/2012 | Kobayashi et al. |
| 8,297,160 | B2 | 10/2012 | Friesen et al. |
| 8,353,475 | B2 | 1/2013 | Kobayashi et al. |
| 8,382,026 | B2 | 2/2013 | Keily et al. |
| 8,402,872 | B2 | 3/2013 | Friesen et al. |
| 8,424,431 | B1 | 4/2013 | Jackman et al. |
| 8,468,920 | B2 * | 6/2013 | Hagleitner ..... A47K 10/3643 83/337 |
| 8,528,851 | B2 | 9/2013 | Friesen et al. |
| 8,555,761 | B2 | 10/2013 | Keily et al. |
| 8,578,826 | B2 | 11/2013 | Hansen et al. |
| 8,651,003 | B1 | 2/2014 | Vercellone |
| 8,733,218 | B2 | 5/2014 | Hansen et al. |
| 8,800,415 | B2 | 8/2014 | Osborne |
| 8,919,233 | B2 | 12/2014 | Lewis et al. |
| 8,943,938 | B2 | 2/2015 | Sahlberg |
| 9,010,602 | B2 | 4/2015 | Budz et al. |
| 9,032,850 | B2 | 5/2015 | Chiba et al. |
| 9,701,508 | B2 | 7/2017 | Diamond |
| 9,756,992 | B2 | 9/2017 | Osbome |
| 9,907,441 | B2 | 3/2018 | Osborne et al. |
| 10,441,117 | B2 | 10/2019 | Osborne, Jr. |
| 2001/0045149 | A1 | 11/2001 | Granger |
| 2002/0073819 | A1 | 6/2002 | Phelps et al. |
| 2003/0019899 | A1 | 1/2003 | Chen |
| 2004/0188486 | A1 | 9/2004 | Granger |
| 2005/0051008 | A1 | 3/2005 | Granger |
| 2005/0145745 | A1 | 7/2005 | Lewis et al. |
| 2005/0167541 | A1 | 8/2005 | Osborne |
| 2006/0037449 | A1 | 2/2006 | Lavallee |
| 2006/0236832 | A1 | 10/2006 | Cvjetkovic et al. |
| 2007/0079684 | A1 | 4/2007 | Friesen et al. |
| 2007/0176041 | A1 | 8/2007 | Friesen et al. |
| 2007/0194166 | A1 | 8/2007 | Reinsei et al. |
| 2007/0215743 | A1 | 9/2007 | Granger |
| 2008/0128448 | A1 | 6/2008 | Cittadino |
| 2008/0217350 | A1 | 9/2008 | Hansen et al. |
| 2009/0057478 | A1 | 3/2009 | Connor |
| 2009/0140001 | A1 | 6/2009 | Lewis et al. |
| 2009/0256022 | A1 | 10/2009 | Maurer |
| 2010/0102101 | A1 | 4/2010 | Keily et al. |
| 2010/0243696 | A1 | 9/2010 | Friesen et al. |
| 2010/0286817 | A1 | 11/2010 | Goeking |
| 2010/0319508 | A1 | 12/2010 | Hagleitner |
| 2011/0068129 | A1 | 3/2011 | Maurer |
| 2011/0133019 | A1 | 6/2011 | Keily et al. |
| 2011/0233318 | A1 | 9/2011 | Anderson |
| 2012/0085857 | A1 | 4/2012 | Vienneau et al. |
| 2012/0167739 | A1 | 7/2012 | Lewis et al. |
| 2012/0182366 | A1 | 7/2012 | Kobayashi et al. |
| 2012/0312853 | A1 | 12/2012 | Osborne et al. |
| 2013/0192437 | A1 | 8/2013 | Sahlberg |
| 2013/0320130 | A1 | 12/2013 | Osborne |
| 2014/0054410 | A1 | 2/2014 | Achton |
| 2014/0263812 | A1 | 9/2014 | Osborne |
| 2014/0312158 | A1 | 10/2014 | Hluschenko et al. |
| 2015/0083846 | A1 | 3/2015 | Budz et al. |
| 2015/0297043 | A1 | 10/2015 | Osborne et al. |
| 2016/0353945 | A1 | 12/2016 | Osborne |
| 2016/0353946 | A1 | 12/2016 | Osborne |
| 2016/0353947 | A1 | 12/2016 | Osborne |
| 2017/0188760 | A1 | 7/2017 | Henson et al. |
| 2017/0367547 | A1 | 12/2017 | Osborne |
| 2017/0369262 | A1 | 12/2017 | Green |
| 2018/0153360 | A1 | 6/2018 | Osborne, Jr. et al. |
| 2018/0170703 | A1 | 6/2018 | Osborne, Jr. |
| 2018/0263433 | A1 | 9/2018 | Osborne, Jr. |
| 2020/0390295 | A1 * | 12/2020 | Osborne, Jr. ..... A47K 10/38 |

OTHER PUBLICATIONS

International Search Report and the Written Opinion of the International Searching Authority for PCT/US2019/033341; dated Sep. 25, 2019.

* cited by examiner

DISPENSER FOR ROLLED SHEET MATERIALS

CROSS REFERENCE TO RELATED APPLICATIONS

The present utility patent application claims the benefit of U.S. Provisional Patent Application No. 62/741,350, filed on Oct. 4, 2018. The present utility patent application also is a continuation-in-part of U.S. patent application Ser. No. 15/988,579, filed on May 24, 2018.

INCORPORATION BY REFERENCE

U.S. Provisional Patent Application No. 62/741,350, filed Oct. 4, 2018, and U.S. patent application Ser. No. 15/988,579, filed on May 24, 2018, are incorporated by reference herein as if set forth in their entireties.

TECHNICAL FIELD

This disclosure generally relates to dispensers and, more particularly, to dispensers for flexible sheet material, such as paper products.

BACKGROUND

Different types of devices for dispensing selected quantities of paper and other flexible sheet products, such as for use in restrooms, hospitals and/or other environments, have been developed in recent years. Some of these dispensers have incorporated mechanical cutting mechanisms that cut or perforate a portion of the paper as it is dispensed, without requiring a user to pull and tear the paper against a tearing mechanism. A drawback with some of these mechanical cutting mechanisms is that their blades or other devices can cause bunching, ripping, or inconsistent cutting of the paper while it is being dispensed, particularly when different grades of paper (i.e., heavier towel type or thinner, tissue type paper). Additionally, such dispensers and cutting systems may produce a significant amount of noise during operation, which noise may be undesirable or disruptive in hospitals, offices, or other environments. Furthermore, a user's pull force may not be sufficient to reset the dispensers and/or the cutting mechanisms. Accordingly, it can be seen that a need exists for a dispenser with a cutting mechanism that provides for reliable cutting or perforation of the sheet material/paper product without bunching or tearing, reduces noise generated as the sheet material is dispensed, provides a biasing force to facilitate resetting of the cutting mechanism, and which addresses the foregoing and other related and unrelated problems in the art.

SUMMARY

Briefly described, in one aspect, the present disclosure includes a dispenser for dispensing a flexible, rolled sheet material. The dispenser typically includes a dispenser housing with a supply of the sheet material supported therewithin, and a drive or feed mechanism. During a dispensing operation, a length or portion of the sheet material will be along a dispensing or feed path/path of travel defined through the housing and to a discharge.

The feed mechanism of the dispenser can include a manual drive or, alternatively, can include a motor driven drive.

In one aspect, the feed roll assembly can include a feed roller rotatably mounted within the housing and arranged along the path of travel of the sheet material. The feed roller can comprise a body having a chamber defined therein, and an exterior surface that at least partially engages the sheet material for feeding or dispensing thereof.

The feed roller can include a biasing assembly with one or more biasing members coupled thereto (e.g., springs or other suitable biasing mechanism) that assist in rotation of the feed roller (e.g., facilitate return of the feed roller to an initial position after manual dispensing of the sheet material).

One or more pressing rollers further can be positioned adjacent the feed roller. The pressing rollers also can be biased toward the body of the feed roller sufficient to engage the sheet material between the one or more pressing rollers and the feed roller so that the sheet material is pulled therebetween and from the supply for feeding along the dispensing path upon rotation of the feed roller during a dispensing operation.

Additionally, the dispenser can include a cutting mechanism or assembly at least partially disposed within the chamber defined by the body of the feed roller. The cutting assembly can include a cutting blade coupled to at least one movable support.

The at least one moveable support further can be operatively connected to the body of the feed roller so as to be actuated with rotation thereof to cause the cutting blade to be moved into and out of one or more openings or a notch or recess defined along the body of the feed roller and at least partially cut, score, or perforate the sheet materials after or during a dispensing operation with the feeding of a selected portion of the sheet material.

The cutting assembly further can include a cam follower (e.g., including a roller or bearing) that is connected to the at least one moveable support, and which engages and rides along a cam surface or track positioned within the chamber of the body of the feed roller as the feed roller is rotated to cause movement of the cutting blade into and out from the one or more openings in the body of the feed roller.

The cutting assembly can include a substantially fixed cam member or track mounted within the chamber of the feed roller body such that the feed roller and the cutting mechanism are rotatable thereabout.

The cam member can have at least one protrusion, or alternatively the track can have an area or portion, shaped, positioned, sized, and/or configured to be engaged by the cam follower to cause rotation or pivoting of the at least one support sufficient to move the cutting blade out of the feed roller body for at least partially cutting, scoring, or perforating the sheet material. The protrusion of the cam member (or area of the track) can have various configurations, including having one or more curved or arcuate surfaces configured to engage the cam follower, in response to which, the cutting blade is moved out of the feed roller body for at least partially cutting, scoring, or perforating the sheet material without scrapping, tearing, and/or ripping thereof.

In one aspect, the at least one moveable support also may be biased, e.g., by one or more biasing members, to urge the cam follower into engagement with the portion or track. In one aspect, In one additional aspect, the cutting assembly can include a linkage driven cutting mechanism (e.g., without biasing members) having at least one support that supports the cutting blade and is connected to an interior surface of the feed roller body at a first portion/end and to a cam follower, such as a roller or bearing that is received within the track, at a second portion/end. As the body of the feed roller rotates the roller connected to the first portion of the support can move about and engage the track, such that the support is pivoted or otherwise moved about the first end thereof connected to the body of the feed roller to move the cutting mechanism into engagement with the sheet material.

The biasing assembly connected to the feed roller to assist rotation thereof and can also facilitate/assist movement of the cutting blade into and out from the one or more openings for at least partially cutting or perforating the selected portion of the sheet material.

The one or more biasing members of the biasing assembly further can extend generally along a longitudinal or rotational axis of the feed roller body.

The biasing assembly also can include one or more linkages and one or more pulleys. The linkage(s) can include one end that is connected to a corresponding biasing member, and an opposing end that is connected to a component of the dispenser that is substantially fixed in relation to the feed roller body. The pulley(s) can be configured to engage the linkage(s) to facilitate a change of direction thereof, such that an axial pull force or tension along the biasing member(s) is converted into a radial pull force or tension to maintain or assist in rotation of the feed roller body and/or facilitate movement of the cutting blade into and out from the one or more openings for at least partially cutting or perforating the selected portion of the sheet material.

Still further, the biasing assembly can include a support assembly configured to support the biasing member(s), linkage(s), and pulley(s) along the feed roller body, e.g., to help facilitate alignment of, or to help to substantially reduce, prevent, or inhibit misalignment of, the biasing member(s), linkage(s), and/or pulley(s) when the biasing assembly is rotated or otherwise moved with the feed roller body.

These and other advantages and aspects of the embodiments of the disclosure will become apparent and more readily appreciated from the following detailed description of the embodiments and the claims, taken in conjunction with the accompanying drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

Figure 1:
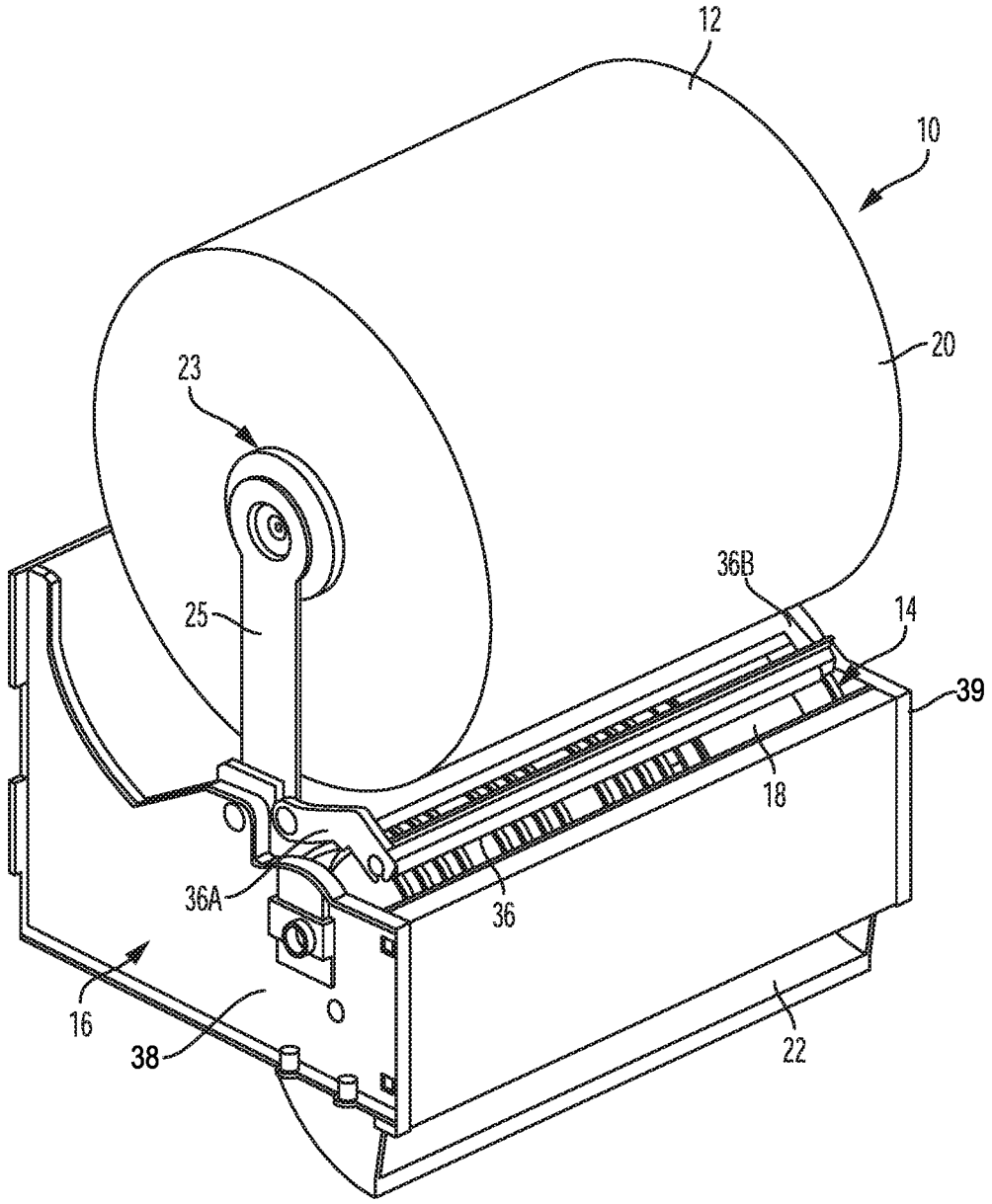
FIG. 1 shows a perspective view of an example sheet material dispenser according to principles of the present disclosure.
Figure 2:
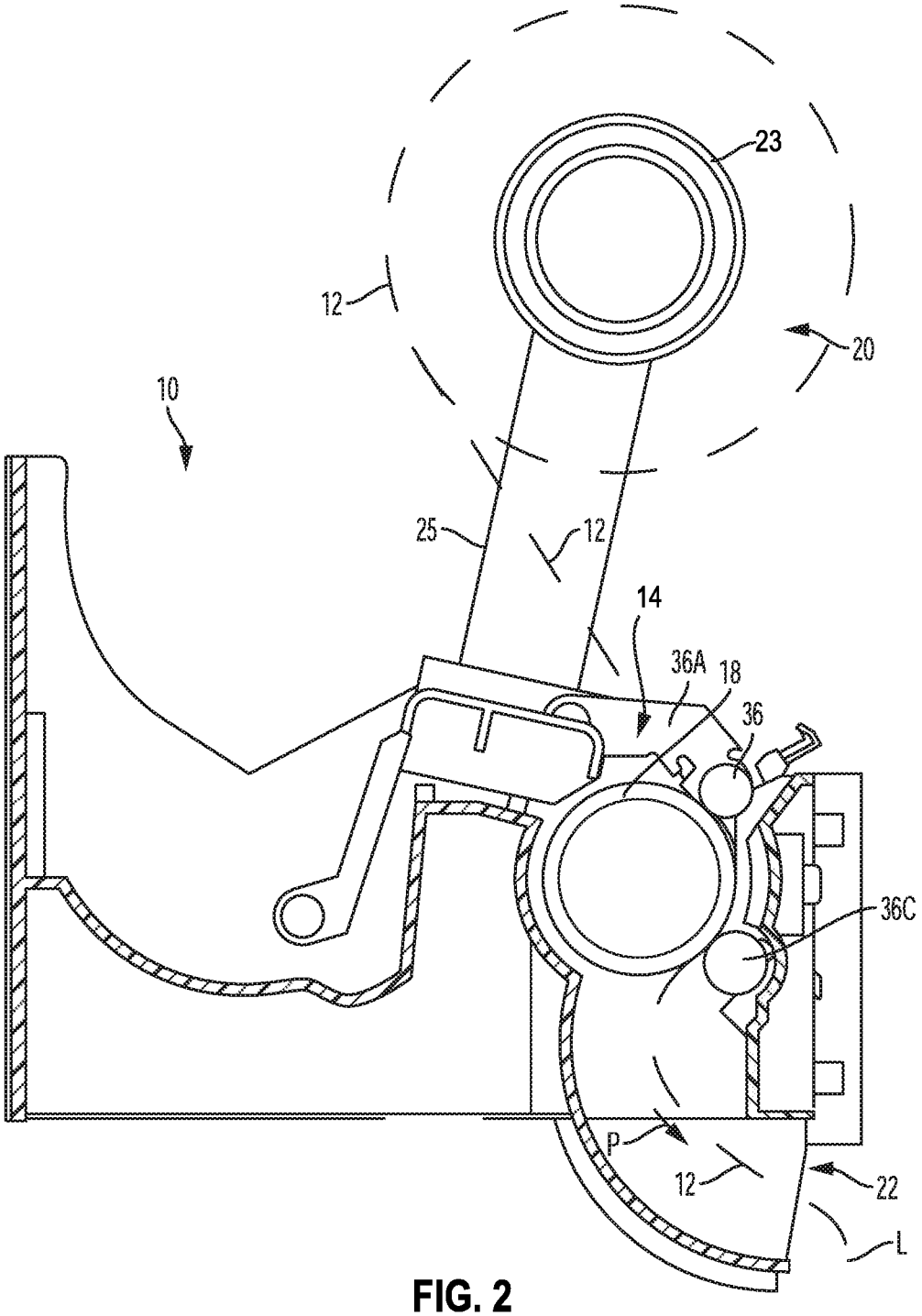
FIG. 2 shows a cross-sectional view of an example dispenser according to principles of this disclosure.
Figure 4A:
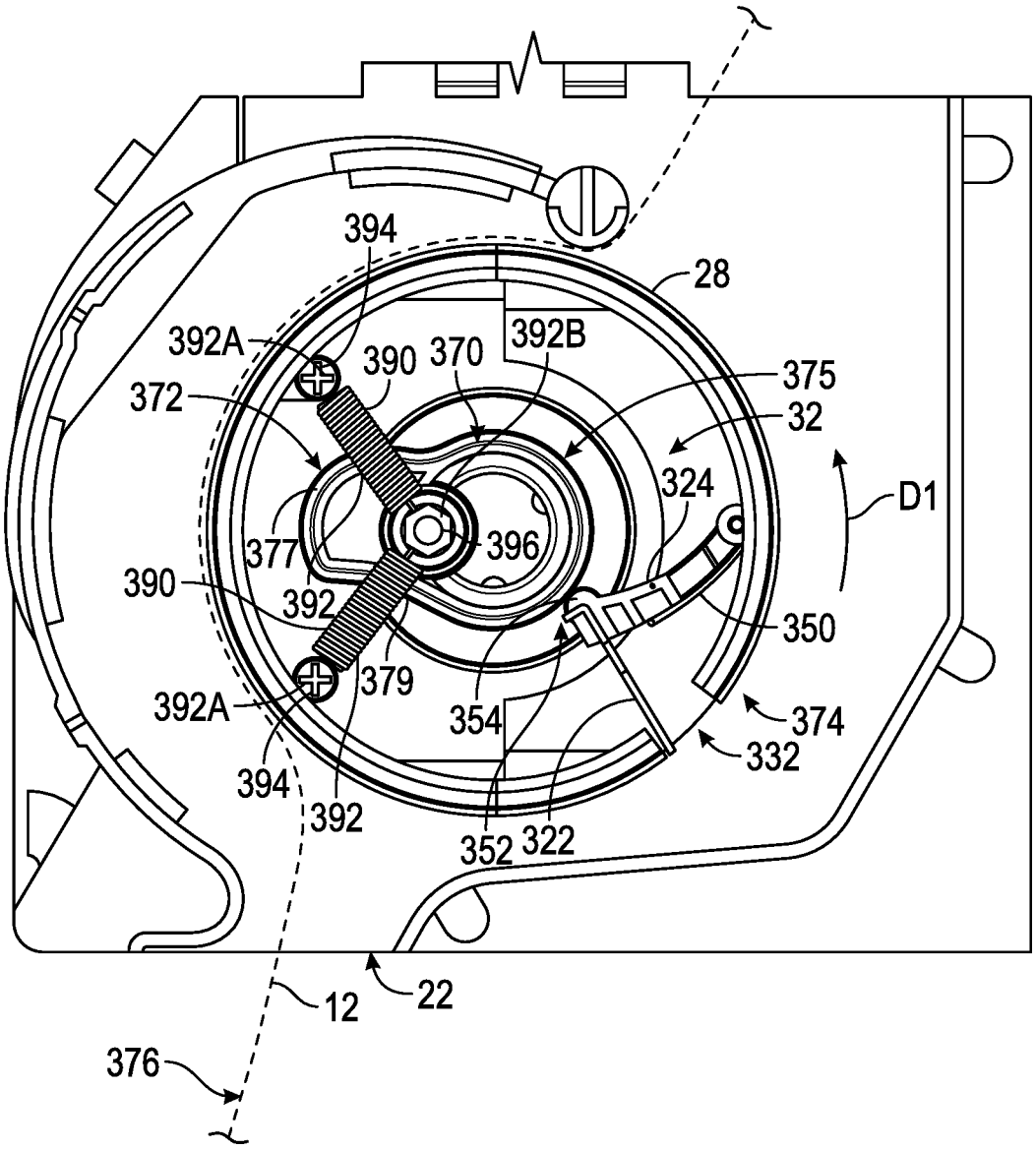
FIGS. 4A, 4B, 4C, 4D, and 4E show cross-sectional views of a feed roller with the cutting system/assembly of FIGS. 3A and 3B.
Figure 4B:
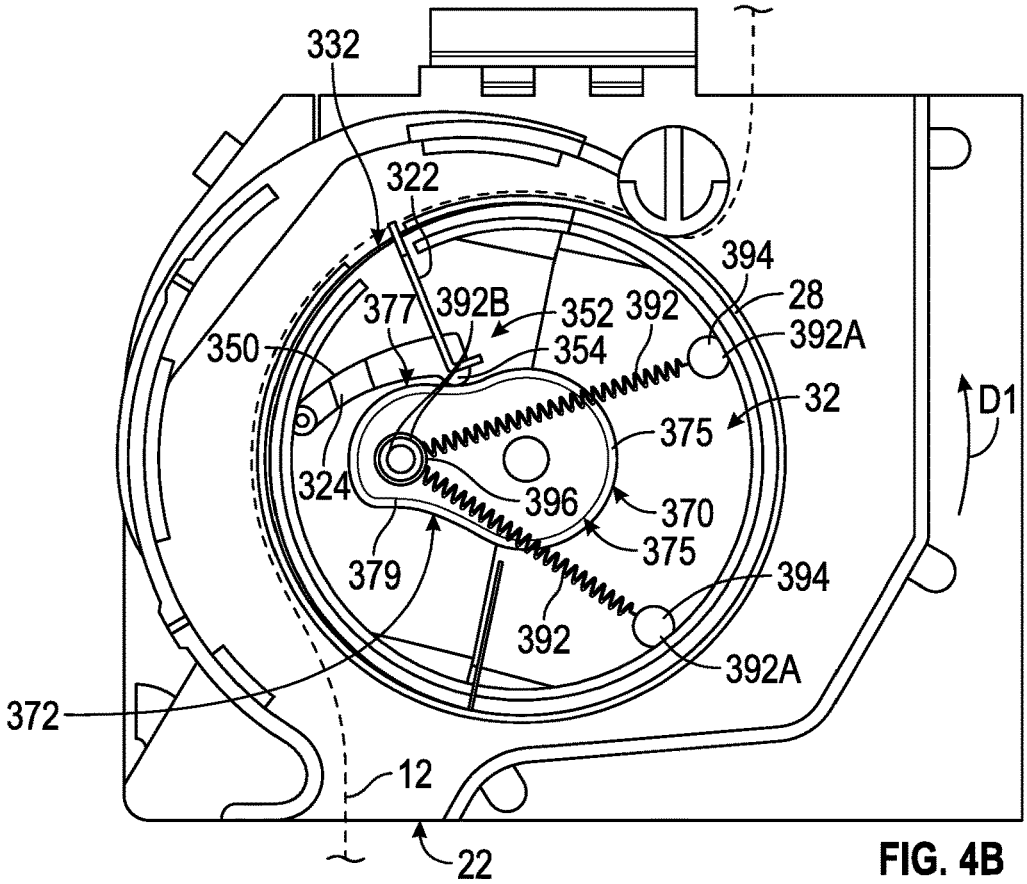
Figure 4C:
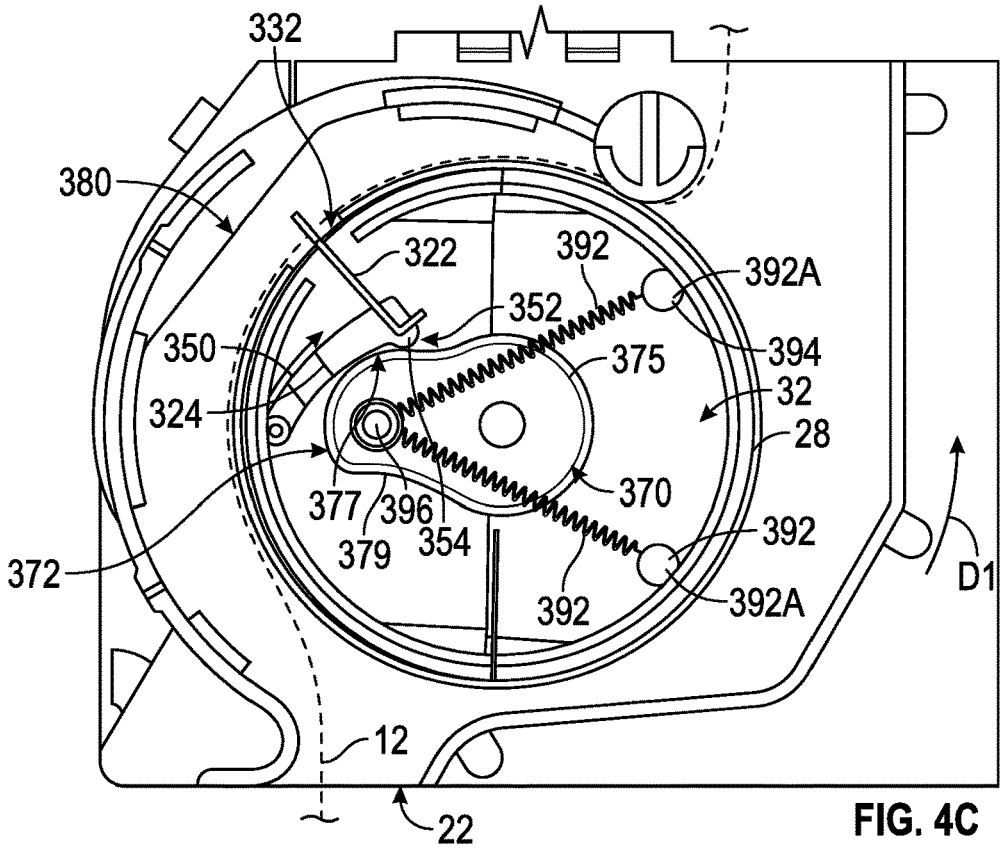
Figure 4D:
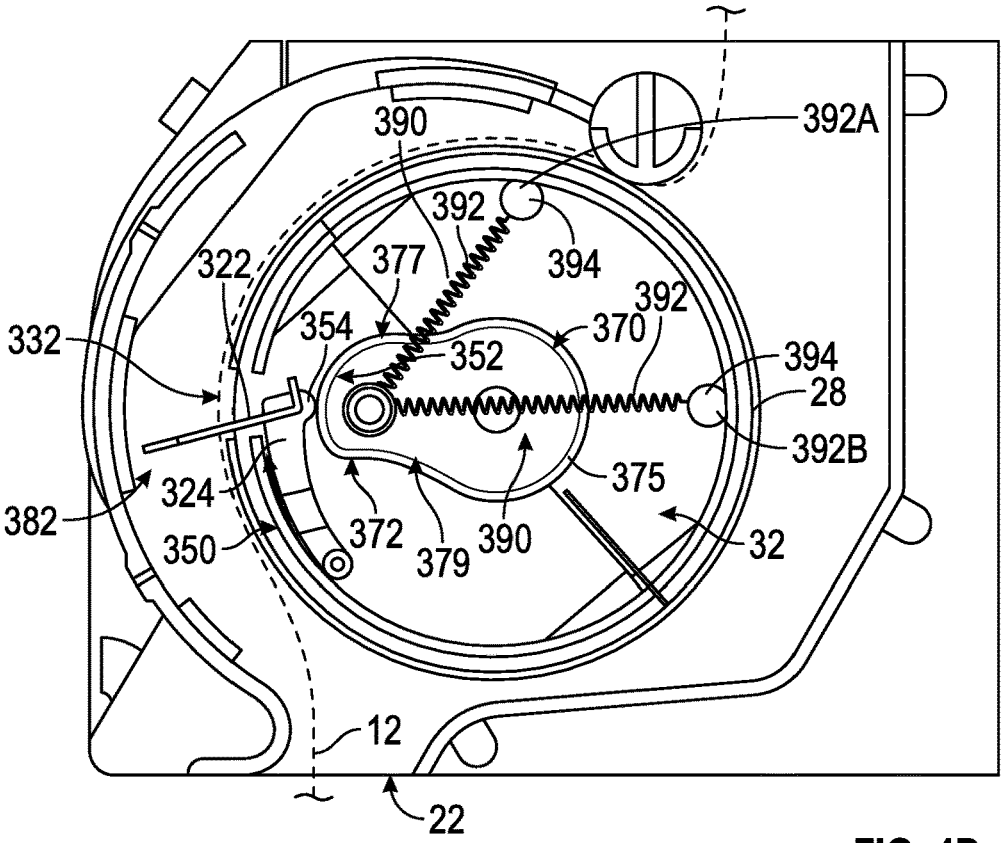
Figure 4E:
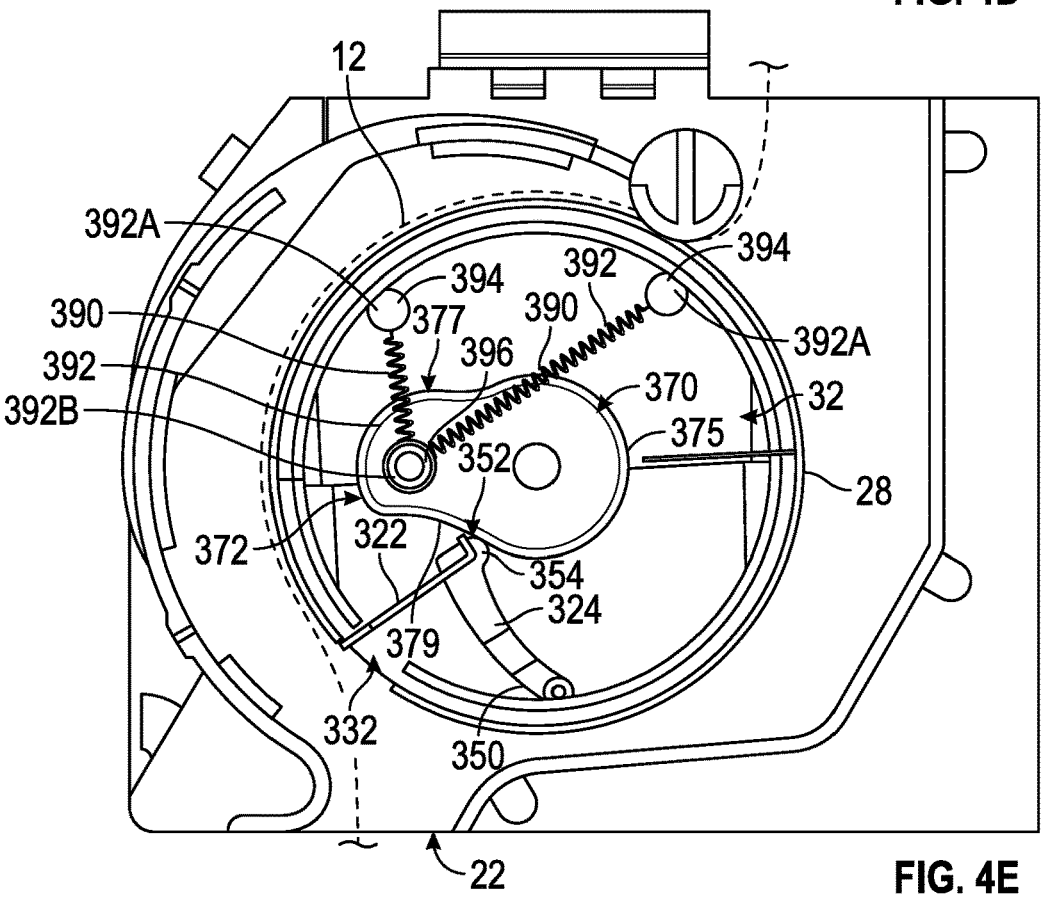
Figure 5:
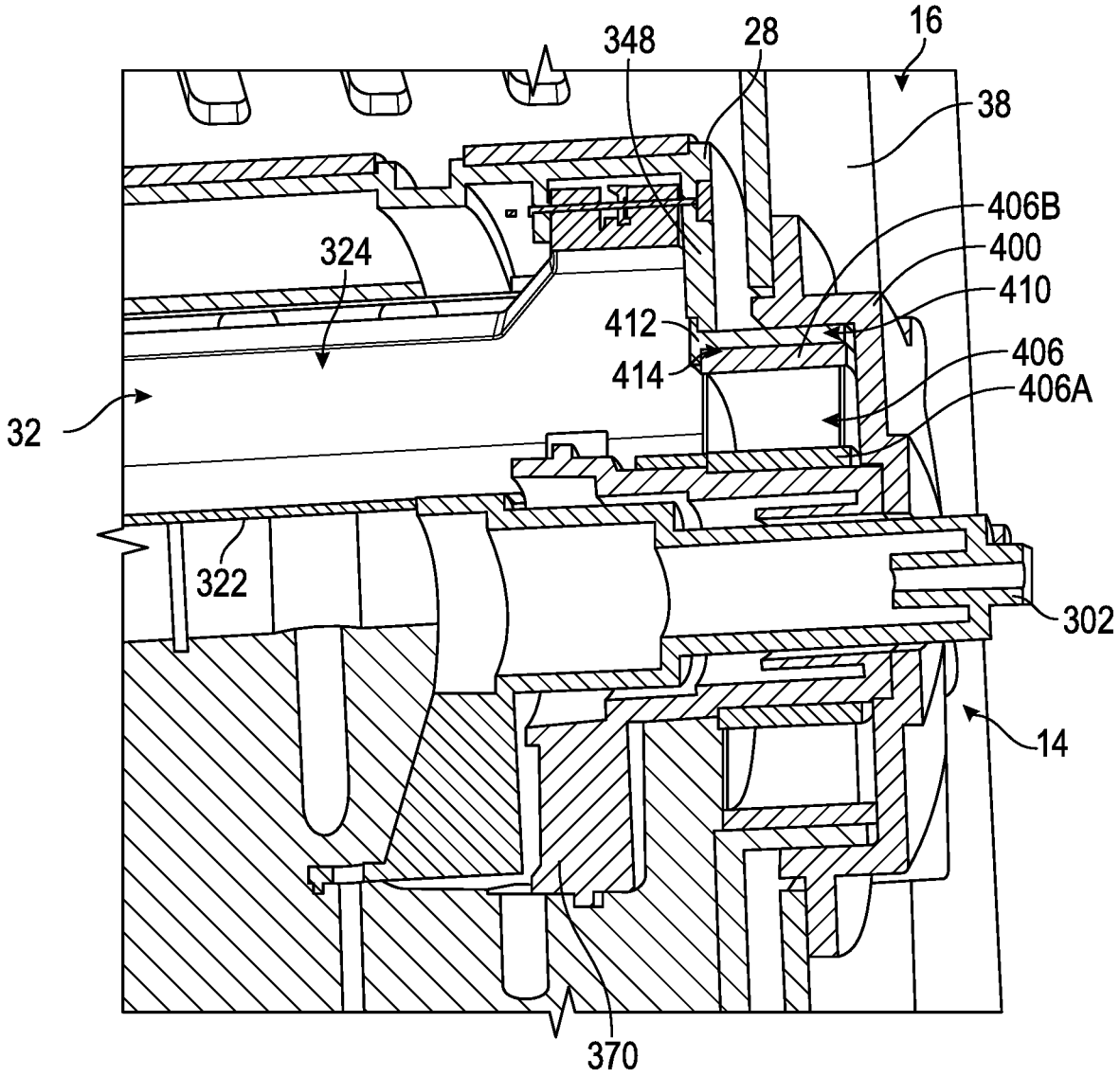
FIG. 5 shows a further cross-sectional view of a feed roller with the cutting system/assembly of FIGS. 5A and B.
Figure 6:
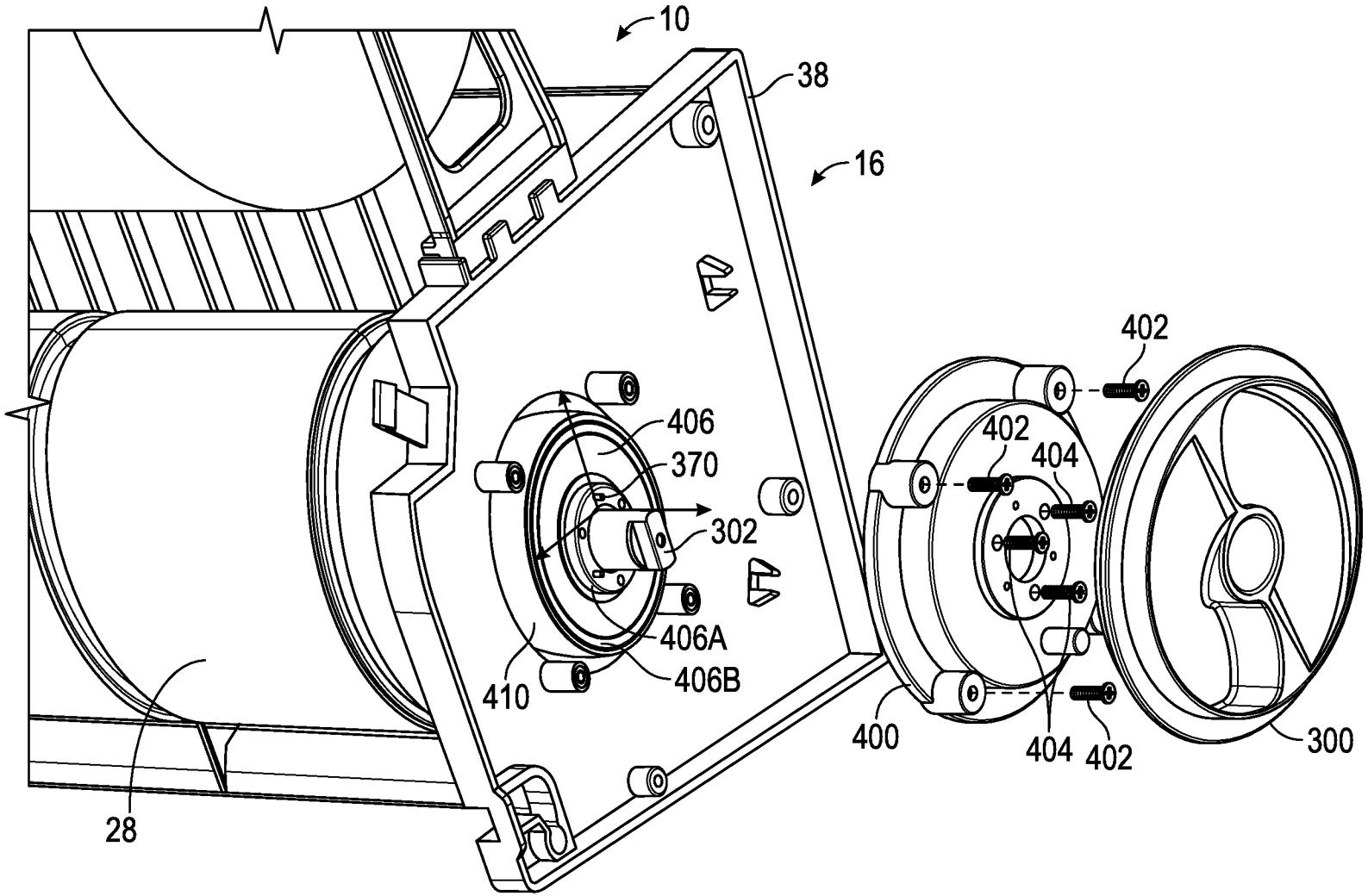
FIG. 6 shows a partial perspective view of an example manually drive mechanism according to principles of the present disclosure.

As generally illustrated in FIGS. 1-10C, the present disclosure is directed to a sheet material dispenser 10 for feeding or dispensing a flexible sheet material 12 (FIGS. 1-2). The dispenser 10 generally includes a feed roller drive assembly 14 mounted/disposed within a dispenser housing 16. The drive assembly 14 generally will be manually operated (as shown in FIGS. 5 and 6); though in some constructions the dispenser can include a motorized/driven feed roller. Upon use or activation of the dispenser 10, the feed roller drive assembly 14 for dispensing sheet material will be engaged, causing rotation of a feed roller or drive spindle 18, thereby resulting in conveyance of a measured or selected amount or length L of sheet material 12 along a conveying or feed path P (FIG. 2) from a roll or supply 20 of the sheet material 12 and out of a dispensing throat or discharge chute 22 or other suitable aperture or opening provided/defined in the housing 16, as generally indicated in FIGS. 1 and 2. It further should be appreciated that the sheet material dispenser 10 described herein should not be considered to be limited to any particular style, configuration, or intended type of sheet material. For example, the dispenser 10 may be operable to dispense paper towels, toilet tissue, or other similar paper or sheet materials, including dispensing or feeding non-perforated and/or perforated sheet materials.

As indicated in FIGS. 1 and 2, the dispenser housing 16 generally includes a roll support mechanism 21, for holding at least one roll 23 of the supply 20 of sheet material 12. For example, the roll 23 can be supported by a pair of arms 25 coupled to the dispenser housing 16. These arms 25 may be fixedly arranged to hold the supply 20 of sheet material in a spaced relationship with the feed roller 18 or, in the alternative, the arms 25 may be biased or urged, such as by a spring, other pre-stressed member or suitable biasing mechanisms, toward the feed roller 18 to urge or direct the supply 20 of sheet material downwardly toward or against the roller 18. In an alternative construction (not shown), the roll support mechanism can include slots or grooves defined in or along the dispenser housing 16 that are configured to receive the first and/or second ends of the roll 23 of the sheet material 12, such that at least a portion of the supply 20 of sheet material 12 is supported by, and/or rests on or engages the feed roller 18. The slots or grooves of the roll support mechanism further can include one or more angled or sloped portions having a variable slope to increase/decrease the amount of force the supply 20 of sheet material exerts on the roller 18. For example, a slope can be selected such that as the supply 20 of sheet material is fed (e.g., the amount of sheet material 12 left on the roll decreases), the slope or position of the supply roll can change so as to keep a downward force exerted on the feed roller 18 by the supply roll substantially constant as the supply of sheet material, and likewise the weight thereof, is diminished as selected portions of the sheet material 12 are dispensed.

FIGS. 1 and 2 further show that the dispenser 10 also can include one or more pressing rollers 36 that can be biased toward engagement with the feed roller 18, so as to engage and force or press the sheet material 12 against the feed roller 18. The pressing roller(s) 36 can be movably mounted within the dispenser housing 16, such as with the ends thereof held within holders or brackets 36A/36B that can be biased toward engagement with the driven feed roller 18 such as by springs, biased cylinders or other suitable biasing mechanisms. The pressing rollers or a single roller, when used, also can be biased independently forward the feed roller. The pressing roller(s) 36 further can include bands of a gripping material, such as a rubber or synthetic material, to assist in pulling the sheet material therebetween without causing damage to the sheet material as it passes between the feed roller and pressing roller(s). Additional pressing or guide rollers 36C also can be arranged along the feed roller 18 to assist in guiding the sheet material, which additional rollers 36C (FIG. 2) may be fixed or biased against the feed roller body 30, such as by springs, biased cylinders or other suitable biasing mechanisms.

Figure 3A:
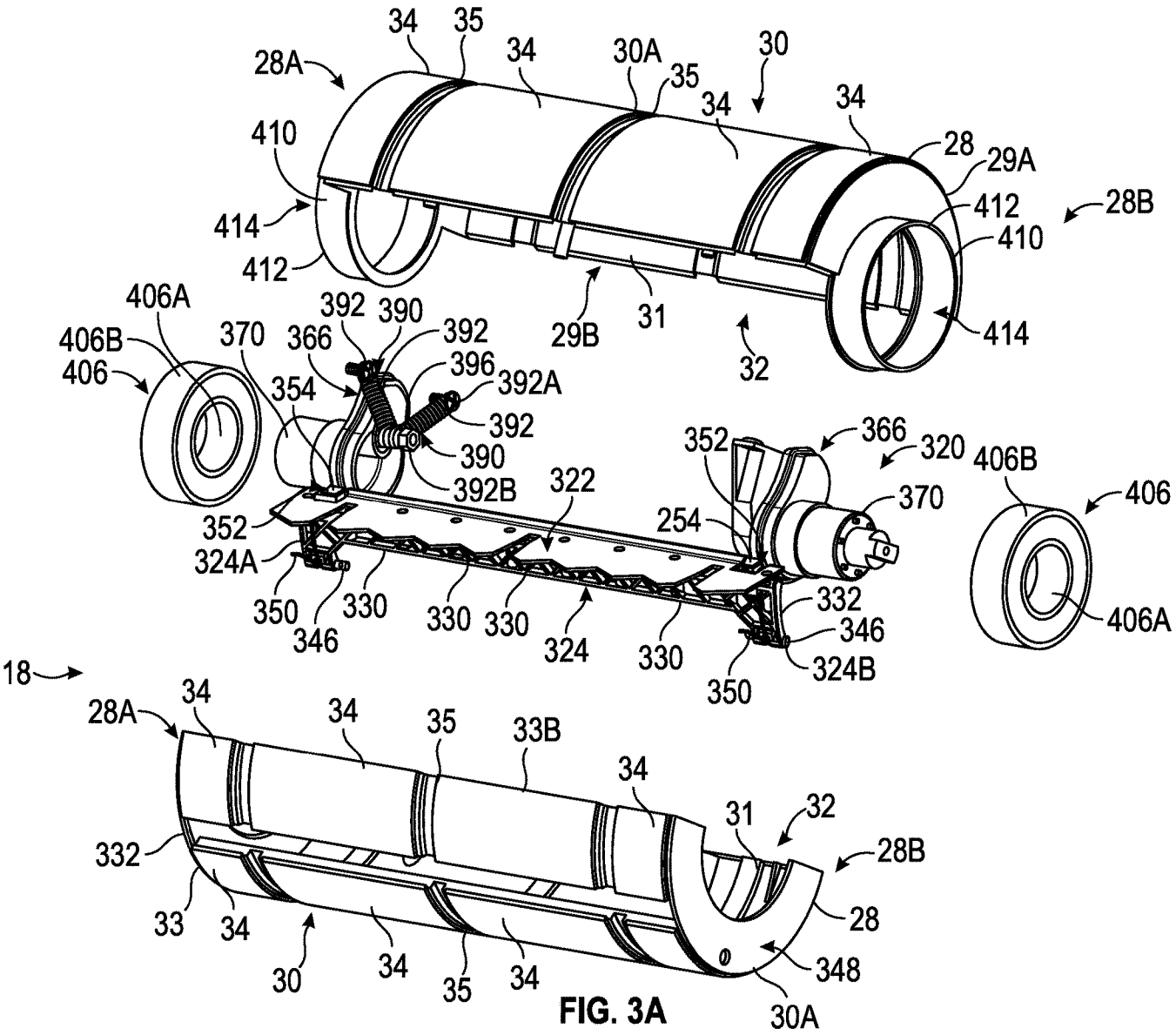
FIGS. 3A and 3B illustrate exploded views of a feed roller and cutting assembly/system according to one aspect of the present disclosure.

FIG. 3A provides an exploded view of the feed roller 18 according to one embodiment. As illustrated in FIG. 3A, the feed roller body 28 may include first and second ends 28A/28B and a generally cylindrical outer side wall 30 and an inner side wall 31 defining an open ended passage, recess, or at least partially hollow cavity 32 defined within/along the feed roller body 28, and the feed roller body 28 may also include one or more driving bands 34 disposed on, or adhered to, an outer surface 30A of the side wall 30, such as a series of driving bands or sections 34 disposed on the outer surface 30A in a spaced arrangement or configuration. The driving bands 34 may at least partially include or be comprised of rubber, plastic, resin or other similar materials suitable to increase grip of the feed roller 18 and/or friction between the feed roller 18 and the sheet material 12 to thereby assist in the feeding or driving of the sheet material 12. In addition, the outer surface 30A of the feed roller body 28 also may include a series of recessed or gap sections 35 defined therein.

As additionally illustrated in FIG. 3A, the feed roller body 28 can be made up of various sections or portions including a first section or portion 29 having, for example, a cylindrical sidewall 29A defining an open ended passage or at least a partially hollow cavity 29B therealong, and a second, or other additional, section or portion 33 connected to and/or adjacent the first section 29 also having, for example, a cylindrical sidewall 33A defining an open ended passage or at least a partially hollow cavity 33B therealong. The feed roller body 28 can be movably or rotatably mounted/attached to one or more walls or other portions of the dispenser housing 16, such as side walls 38/39 (FIGS. 1 and 5-6). The first 28A and/or second 28B ends of the feed roller body 28 can be connected, mounted or otherwise coupled to the side walls 38/39 by one or more bearing assemblies 406 (FIGS. 3A and 5-6), and/or other suitable support mechanisms that support and allow for rotation of the feed roller body 28 in relation to the dispenser housing 16. The bearings 406 may include roller or ball bearings, though embodiments of this disclosure are not so limited and may include plain, fluid, or magnetic bearings or any other suitable mechanisms for rotatably fixing the feed roller body 28 to or within the dispenser housing 16. The first 28A and/or second 28B ends of the feed roller body 28 can be receive and engage the bearing assemblies 406 to enable the feed roller body 28 to rotate with respect to the dispenser housing 16 (FIGS. 3A and 5-6).

FIGS. 3A-B and 4A-E show a dispenser cutting assembly or system 320 according to one embodiment of the present disclosure, wherein the cutting assembly 320 can include a cutting blade 322 and a base or support 324 connected to and at least partially supporting the cutting blade 322. The base 324 can be pivotably or otherwise movably mounted within the cavity or chamber 32 defined within the feed roller body 28, such that teeth or sharpened portions 330 of the cutting blade 322 are extensible between extended and retracted positions out of and back through an opening or slot 332 defined along the feed roller body 28 by movement of the base.

Figure 3B:
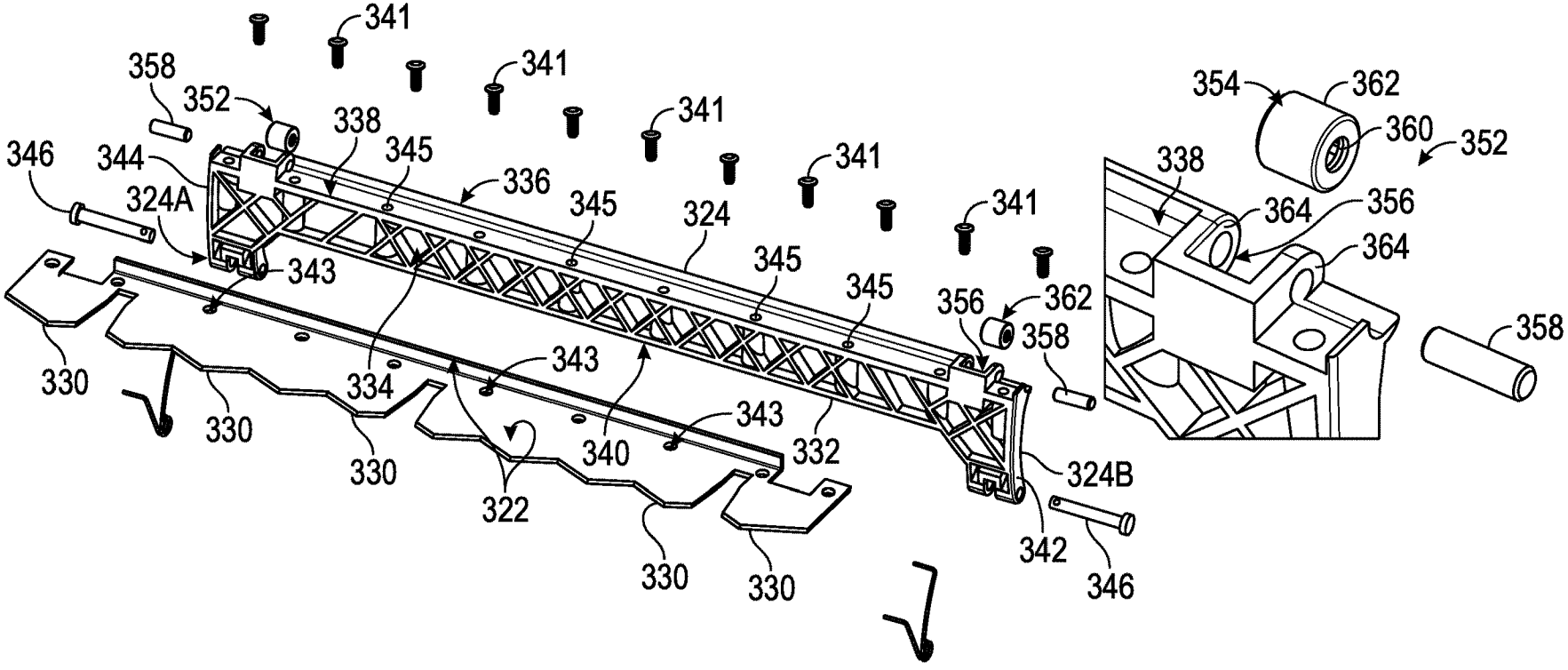

The base 324 can have a body 332 with front 334, back 336, top 338, bottom 340, and side 342/344 portions or sections (FIG. 3B). In one embodiment, the body 332 of the base 324 further can be formed from a plastic material or other polymeric material, though other suitable materials, such as rubber, wood, composites, etc., also can be used without departing from the scope of the present disclosure. The base 324 further generally will be coupled or connected to the cutting blade 322 along the top portion 338 of the base 324, for example, by a series of fasteners 341, such as screws, bolts, rivets, etc., that can be received and/or threaded through a series of holes 343 defined in/through the cutting blade 322 as well as corresponding holes 345 defined in the top portion of the base 324. However, the cutting blade 322 can be otherwise fixed to or integrally formed with the support/base 324, without departing from the scope of the present disclosure.

As generally shown in FIGS. 4A-E, the base 324 further is rotatably or pivotally coupled to at least a portion of the feed roller body 28. For example, the cutting assembly 320 can include pins 346, or other suitable connection means or connecting members, e.g., rods, bearings, etc., allowing for pivoting or rotation thereabout, to couple to ends 324A/B of the base 324 to side walls 348 of the feed roller body 28 such that the base/support 324 is rotatable/pivotable about the pins 346 and further moves/rotates with the feed roller body 28 during dispensing of the sheet material. Additionally, the cutting assembly 320 can include one or more biasing members 350, such as torsion springs, or other suitable biasing members, that are coupled to pins 346 and provide a biasing force against the support/base 324, e.g., sufficient to urge or bias the support/base 324, and thus the cutting blade 322, toward a retracted position.

FIGS. 3A-3B and 4A-4E also show that the base 324 also has a cam follower assembly 352 arranged along the top portion 338 thereof. The cam follower assembly 352 generally has one or more cam followers 354, which can include bearings, rollers, or other rotating members or portions. In one embodiment, the cam followers 354 can be at least partially received within notches or grooves 356 defined in the top portion 338 of the base 324, and can be rotatably coupled thereto by rods or pins 358, or other suitable connection mechanisms, as generally shown in FIG. 3B. The rods or pins 358 each further can be received/engaged within a hole or passage 360 defined through a body 362 of each cam followers 354 and corresponding holes/passages 364 defined along the top portion 338 of the base 224, to rotatably couple the cam followers 354 to the base 324, as generally shown in FIG. 3B.

The cam followers 354 engage and move along one or more corresponding cam surfaces or tracks 366 located within the cavity 32 of the feed roller body 28, as the feed roller body 28 is rotated, and correspondingly pivot/rotate the base 324 and move the cutting blade 322 out from and back into the opening/slot 332. For example, in one embodiment, the cutting assembly 320 can include cam members 370 that can be mounted in a substantially fixed or stationary position within the cavity 32 of the feed roller body 28, such that the feed roller body 28 and the base 324 are rotated about such cam members 370, such as indicated in FIGS. 4A-E.

The biasing member 350 further can bias or urge the cam followers 354 against and into engagement with at least a portion of the cam members 370. The cam members 370 further can have one or more protrusions, protuberances, or extending portions 372 provided therealong, such that when the protrusion(s) 372 are engaged by the cam followers 350 the biasing force of the biasing member 350 is overcome to cause the base/support 324 to pivot, rotate, or otherwise move and thereby extend the cutting blade 322 out from the opening/slot 332 in the feed roller body 28 for at least partial perforation or cutting of the sheet material. Accordingly, as shown in FIGS. 4A-E, as the feed roller body 28 is rotated to dispense sheet material 12 (and the base 324 is rotated therewith) the cam followers 354 will be pressed against/into engagement with and moved along the cam members 370 such that the support/base 324 pivots or moves the cutting blade 322 between a plurality of extended and retracted positions 374, 380, 382.

As shown in FIG. 4A, the cutting blade 322 initially can be in a rest or initial position 374, with the cam followers 354 engaging a surface or portion 375 of the cam members 370 such that the cutting blade 322 is retracted from the opening 332 in the feed roller body 28. In this rest/initial position 374, a tail or portion 376 of the sheet material 12 may hang or otherwise extend from the discharge chute 22 of the dispenser. It will, however, be understood that the present disclosure is not limited to this arrangement, and the sheet material 12 may be concealed within the dispenser or in any other suitable arrangement, without departing from the scope of the present disclosure.

FIGS. 4B-C also indicate that when the feed roller body 28 is rotated to dispense a selected amount of sheet material, for example, upon a manual activation of the dispenser, e.g., when a user turns a knob or lever 300 operatively connected to the feed roller body 28 by a post or support 302 (FIGS. 5 and 6) or pulls on the tail 276 of a hanging sheet or portion of sheet material extending from the discharge, the cam follower 354 will move along surface 375 until the cam follower 354 engages a cam surface or portion 377 of a protrusion 372 of the cam member 370 and is moved to an extent sufficient to overcome the biasing force of the biasing member 350. In response, the support/base 324 will be pivoted so as to move the cutting blade 322 to exit the opening 332 defined in the feed roller body 28 to cut, score, or perforate the sheet material 12.

In addition, FIG. 4B shows that when the feed roller body 28 is rotated an initial amount, e.g., rotated approximately 150° to approximately 180°, such as approximately 170°, from the rest position 374 in a counterclockwise direction D1, the cam follower 354 generally will begin to engage the surface or portion 377 of the protrusion 372 and the cutting blade 322 will begin to exit the opening 332. Thereafter, as shown in FIG. 4C, as the feed roller body 28 is rotated a further amount, e.g., rotated approximately 170° to approximately 200°, such as approximately 180°, from the rest position 374 in the counterclockwise direction D1, to the cam follower 354 is moved further along the surface/portion 377, causing the cutting blade 322 to extend further toward a cutting position 380 with the cutting blade 322 contacting or otherwise engaging the sheet material for cutting or perforation thereof. In one embodiment, the cam surface or portion 377 of the protrusion 372 further generally can be sloped, curved, or otherwise shaped or configured to help control the engagement of the cutting blade with the sheet material so as to substantially prevent ripping or tearing during cutting, scoring, or perforation thereof.

Subsequently, as illustrated in FIG. 4D, when the feed roller body 28 rotates an even further amount, e.g., approximately 220° to approximately 240° or more, such as approximately 230°, from the rest position 374 in the counterclockwise direction D1, the cam follower 354 is moved further along the cam surface or portion 377 such that the cutting blade 322 is moved to its fully extended position 382, with the cutting blade 322 substantially projecting or extending out of the opening 332 in the feed roller body 28.

Thereafter, as the feed roller body 28 continues to rotate and as the cam follower 354 engages and moves along cam surface or portion 379 of the protrusion 372, the cutting blade 322 is retracted back through the opening 332 in the feed roller body 28 (FIG. 4E). Additionally, when the feed roller body 28 has made a full rotation, e.g., rotated approximately 360° from its initial or rest position 374, the cam follower 354 will again engage the cam surface or portion 375 of the cam members 370 such that the cutting blade 322 is in its retracted or initial position (FIG. 4A)

FIGS. 4A and 4A-E additionally show that the feed roller body 28, in some embodiments, can include a biasing assembly 390 disposed within the body and operable or configured to assist rotation of the feed roller body 28 and/or movement of the cutting assembly 320, for example, upon manual activation of the feed roller body 28. The biasing assembly 390 can include tension springs 392, e.g., one or two tension springs, though any suitable number of springs, such as 3 or more, also can be employed without departing from the scope of the present disclosure. The springs 392 generally will be fixably connected to the feed roller body 28 and rotatably coupled to at least a portion of one of the cam members 370, or other suitable fixed portion positioned within the cavity 326 of the feed roller body 28. For example, one end 392A of the springs 390 can be fixably connected, such as by fasteners 394, e.g., screws, bolts, rivets, etc., to the feed roller body 28, and an opposite/opposing end 392B of the springs 392 can be rotatably connected, such as by a bearing assembly 396, or other moveable/pivotably assembly, to one of the cam members 370. The springs 392 also can be arranged such that they are transverse or oblique to one another, for example, the springs 392 can be disposed to have an angle of approximately 30°-45° therebetween, though lessor angles and/or angles up to 90° or more can be used without departing from the scope of the present disclosure.

As shown in FIG. 4A, with the cutting blade 322 at its initial or rest position 374, the springs 392 can have an initial or equilibrium length. Then, as the feed roller body 28 is rotated, the springs 392 will be elongated and can provide biased assistance for rotation of the feed roller body 28, with the spring tension further assisting movement of the cutting blade 322 for cutting, scoring, or perforating the sheet material. The springs 392 further can cause the feed roller body 28 to fully rotate, e.g., rotate approximately 360°, while also helping to return the cutting blade 322 to its initial or rest position 374, retracted into the body 28 of the feed roller.

FIGS. 5 and 6 also indicate that the cam members 370 can be attached to at least a portion, e.g., side walls 38/39, of the dispenser housing 16, for example, by support caps 400. The support caps 400 can be connected to the side walls 38/39 of the dispenser housing 16 by fasteners 402, e.g., screws, bolts, rivets, etc., and further can be connected to the cam members 370 using fasteners 404, such as screws, bolts, rivets, etc., to mount and support the cam members 370 within the cavity 326 of the feed roller body 28. As a result, the feed roller body 28 and the base 324, with the cutting blade 322 attached thereto, are supported in a manner so as to be generally rotatable about the cam member 370. Other connectors also can be used to connect the support caps 400 to the dispenser housing 16 and the cam members 370, however, such as, for example, snap-fit or press-fit connections, adhesives, etc., without departing from the scope of the present disclosure.

As further shown in FIGS. 3A, 5, and 6, the feed roller body 28 can be rotatably coupled to the cam member(s) 370 by bearings 406. For example, at least a portion of the cam members 370 will be received within a passage 408 defined through the bearings 406, and can engage an inner race 406A of the bearings 406. The bearings 406 further will be connected to the feed roller body 28 by one or more support portions 410, each of which can include a body 412 having a ring-like or circular shape and connected to or integrally formed with the sidewalls 348 of the feed roller body 28, as generally indicated in FIGS. 3A and 5. The bearings 406 further generally can be received within, e.g., fitted into, a passage 414 defined through the body 412 of each of the supports 410 to operatively connect the feed roller body 28 to an outer race 406B of the bearings 406.

Figure 7A:
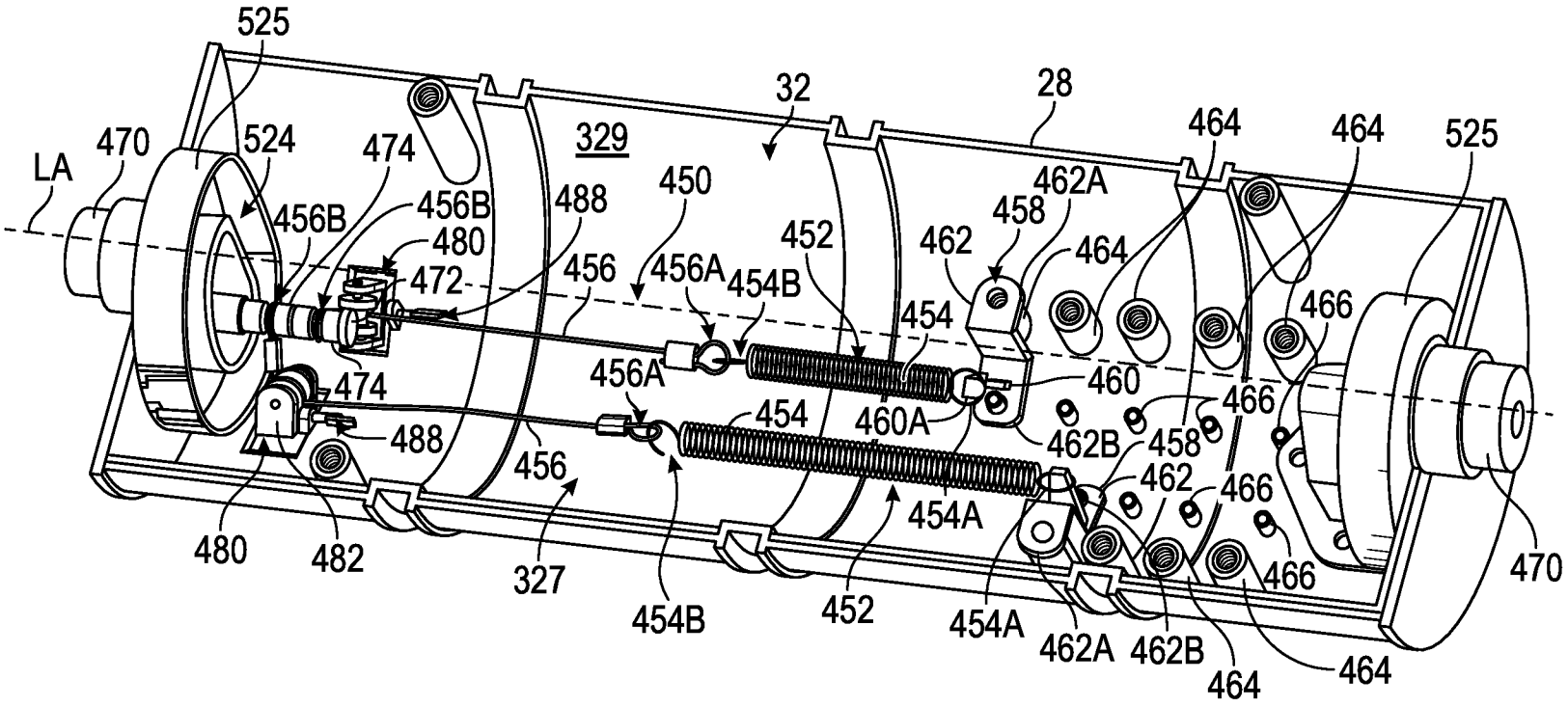
FIGS. 7A and 7B show a side elevational view and a partial side elevational view of a biasing assembly for controlling movement of a feed roller and/or cutting mechanism according to one aspect of the present disclosure.
Figure 7B:
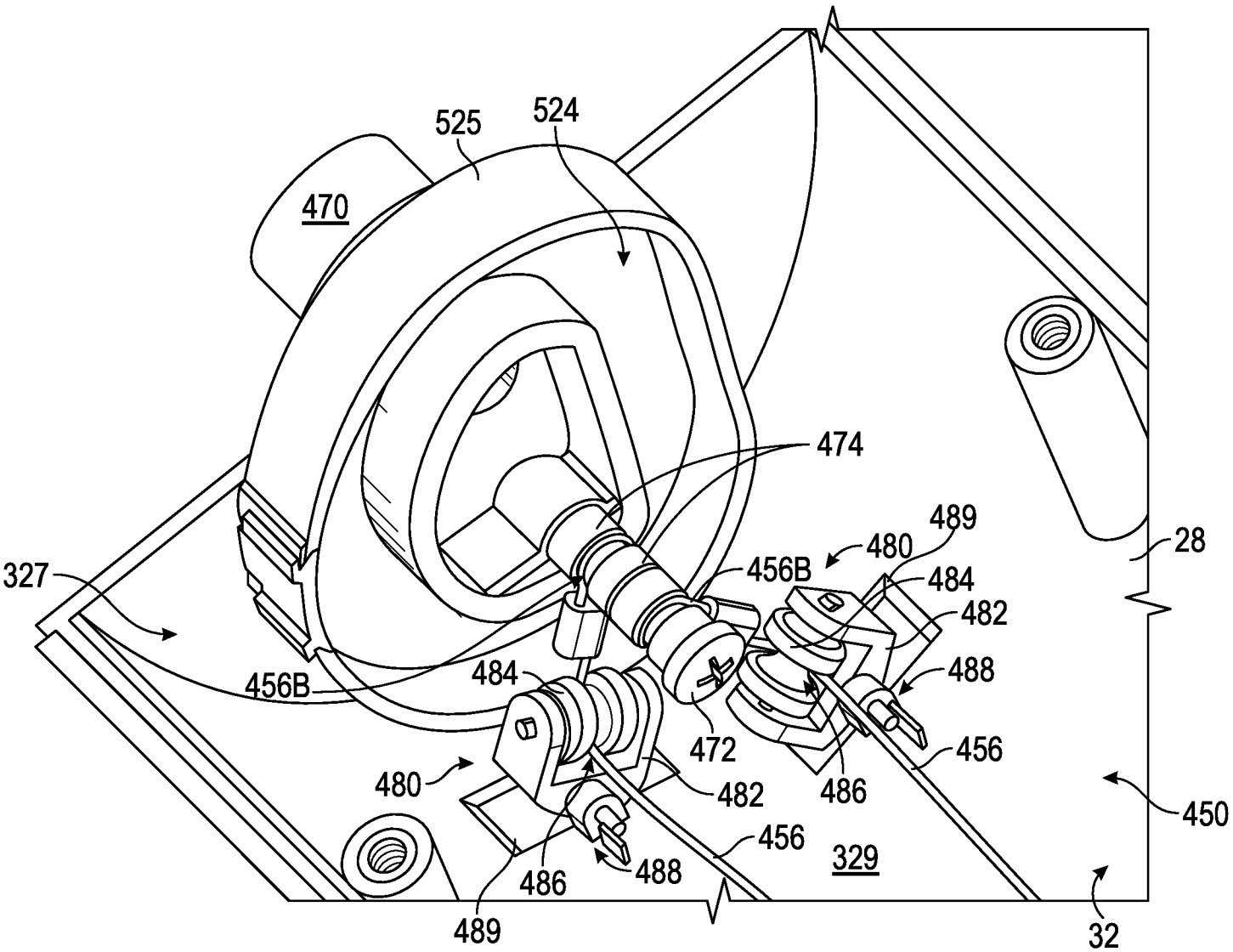

FIGS. 7A and 7B show a biasing assembly 450 for assisting in the operation/movement of the feed roller (such as for use in a manually driven or similar operation of the feed roller) for assisting movement of the feed roller for an operative cycle and to a rest or home position, wherein the cutting blade can be retracted to a non-operative position (e.g., within a recess, notch, opening, etc. in the feed roller body), according to an additional embodiment of the present disclosure.

As also shown in FIGS. 7A and 7B, the biasing assembly 450 can include one or more biasing members 452, e.g. in the embodiment illustrated, a pair of biasing members 452 are shown extending along the interior surface 329 of the feed roller body 28. It will be understood that fewer or more biasing elements can be used without departing from the scope of the present disclosure. Each biasing member 452 can comprise a tension spring or other suitable tensioning or biasing member having an elongated spring body 454 with first and second ends 454A/B. The biasing members 452 also generally extend in a direction along, e.g., generally parallel, to the longitudinal (or rotational) axis (axis LA shown in FIG. 7A) of the feed roller body 28, and can be fixably attached to the interior surface 329 of the feed roller body 28.

The first or distal end 454A of each biasing member 452 can engage and couple to a connection mechanism 458, such as flange, arm, or other connecting member attached to the feed roller body 28 by one or more fasteners, (e.g., a screw, rivet, or other fastener). For example, in one embodiment, as illustrated in FIGS. 7A-7B, the first end 454A of the spring body 454 of each biasing member 452 can include a hoop, ring, hook or other suitable feature or mechanism that connects to a protruding portion 460 formed with, or connected to the connection mechanism 458, which portion 460 has a notch or opening 460A for receiving the hoop, ring, or hook of the spring. The second end 454B of each biasing member 452 can be similarly attached to a connecting linkage 456 that is connected to a bearing assembly 470 for the feed roller as indicated in FIGS. 7A-7B.

In one example, the connection mechanism 458 can include a body 462 that is connected to, or engages, portions or protrusions 464 and 466 fixed to, or integrally formed with, the feed roller body 28, e.g., at first and second ends 462A and 462B of the body 462. The protrusions 464 and 466 can be received within openings or apertures defined along the ends 462A and 462B of the body 462, and/or can include threaded openings defined therein to receive fasteners passed through the openings in the ends 462A/462B of the body 462 to secure the body 462 to the feed roller body 28. The body 462 can have a generally Z-shaped cross-section to facilitate connection of the body 462 to the portions 464/466, though the body can have other suitable shapes and configurations, without departing from the scope of the present disclosure.

In one variation or alternative constructions, the feed roller body 28 can have a plurality of attachment points 464/466 about the interior surface 329 thereof. For example, the feed roller body 28 can have multiple portions 464/466 formed/connected to the feed roller body 28 in spaced series to allow for adjustment (e.g., tightening or loosening) of the biasing members 452, e.g., to accommodate different sheet material sizes and/or to correct for time dependent displacement or movements of the spring due to the repeated loading. In one embodiment, up to five attachment points can be provided, though any suitable number of attachment points, e.g., 2, 3, 4, or more than 5, can be employed without departing from the scope of the present disclosure.

FIGS. 7A and 7B further show that each linkage 456 can include a wire, band, or rod 468, or other flexible coupling, with first and second ends 456A/456B. The first end 456A of each linkage 456 can be formed as a looped end, and can be connected to the second end 454B of its corresponding biasing member 454 such as by a hook, hoop, or split-ring type of connection forming the second end 454B of the biasing member 454. The second end 456B of each linkage 456 can be formed with a similar looped end and generally will be rotatably connected to the bearing assembly 470, such as by attachment to a fastener 472 (e.g., screw, bolt, etc.) or other suitable connection mechanism. The fastener 472 also can have one or more spacers 474 received therealong to engage and facilitate alignment of the second looped ends 456B of the linkages 456 (FIGS. 7A and 7B).

Additionally, the biasing assembly 450 can include one or more pulley assemblies 480 (as shown in FIGS. 7A and 7B) that engage and facilitate a change in the direction of the linkages 456 operatively connecting the biasing members 452 to the bearing assembly 470 (e.g., such that an axial pull force or tension along the biasing members 452 can be converted into a radial pull force or tension to maintain or assist in rotation of the feed roller body 28 and/or movement of the cutting mechanism). Each of the pulley assemblies 480 can include a bracket 482 that is connected to the interior surface 329 of the feed roller body 28 and that at least partially supports a pulley 484 having a track or race 486 against which at least a portion of the linkage 456 is engaged and/or moves.

As shown in FIG. 7B, the pulley brackets 482 can be pivotably or rotatably mounted (e.g., by a pinned or hinged connection 488) to the interior surface 329 of the feed roller body 28. The pinned or hinged connection 488 can help to maintain engagement between, or substantially prevent disalignment of, the linkage 456 and the race 486 of the pulleys 484, e.g., as/when the feed roller body 28 is rotated and the biasing assembly 450 is rotated therewith. The interior surface 329 of the feed roller body 28 further can have a notch or recessed portion 489 formed/defined therein to accommodate movement/pivoting of the brackets 482.

In operation, upon activation of the feed roller 28 (e.g., when a user pulls a hanging tab or portion of sheet material or turns a knob or lever connected to the feed roller), the feed roller body 28 rotates and carries the biasing assembly 450 therewith. As a result, the linkages 456 are caused to be pulled or otherwise engaged about the pulleys 484, tensioning and stretching the spring bodies of the biasing members 452, thus creating tension in or along the biasing members 452. This tension assists in the rotation of the feed roller and helps urge the feed roller body 28 to facilitate return of the feed roller body 28 to its rest or home position. In one example, the rotation of the feed roller can be sufficient to generate a tab or portion for pulling or engagement by subsequent users for dispensing a selected portion of sheet material. Also, this tension helps facilitate rotation of the feed roller body 28 sufficient to cause activation or movement of the cutting blade of the dispenser to cut, perforate, or otherwise cause or assist in separation of a sheet of the paper material. The return movement of the feed roller body 28 also can cause retraction of the cutting blade (e.g., into a notch, recess, opening, etc. in the feed roller body).

Figure 8A:
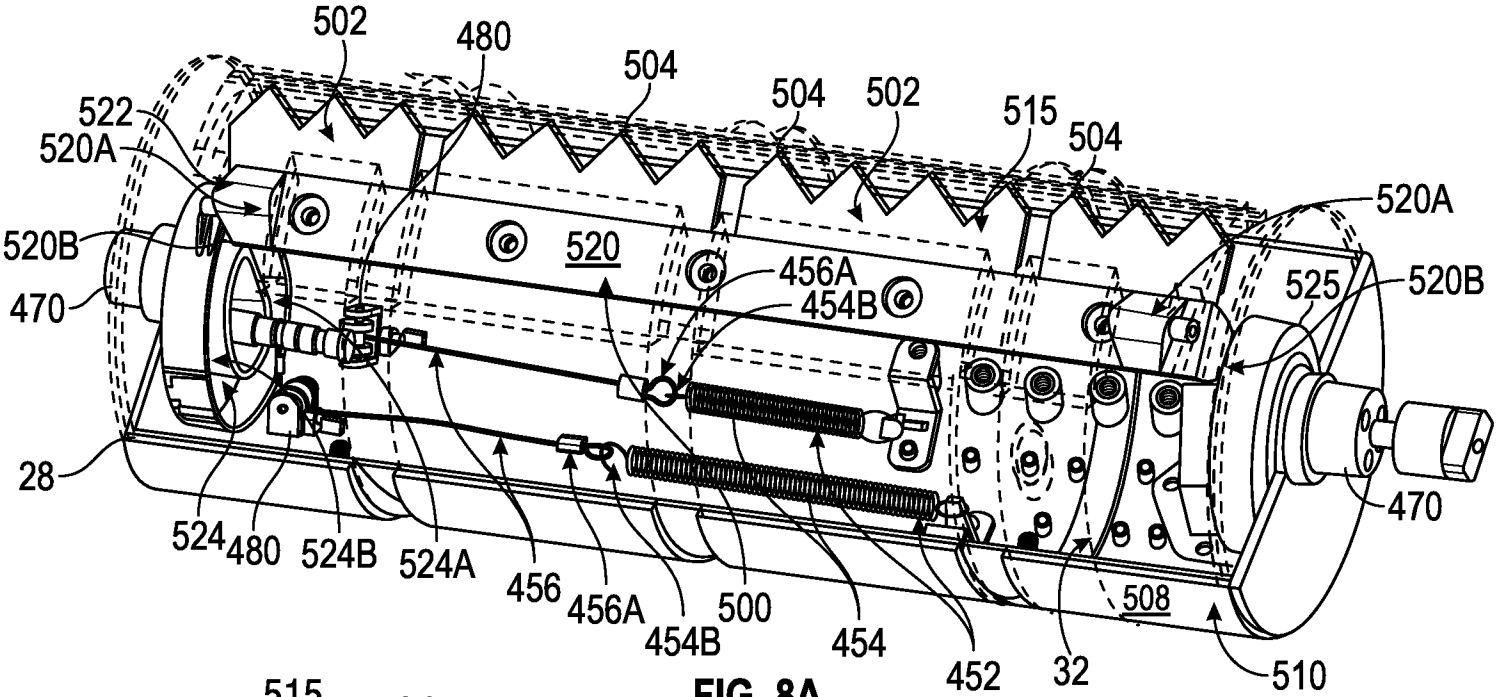
FIGS. 8A and 8B show side elevational views of the feed roller with a cutting system according to an additional aspect of the disclosure.
Figure 8B:
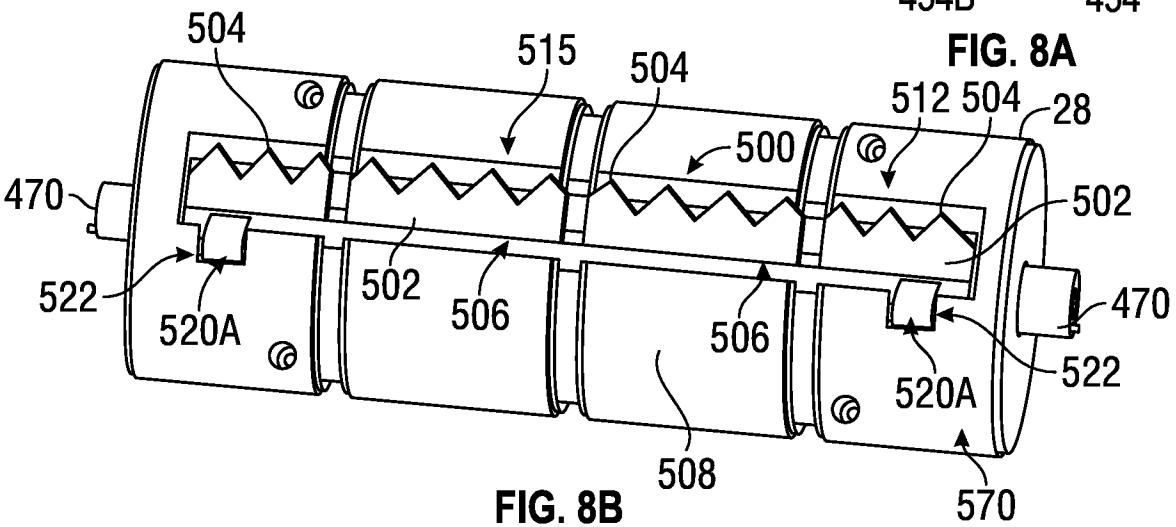
Figure 9A:
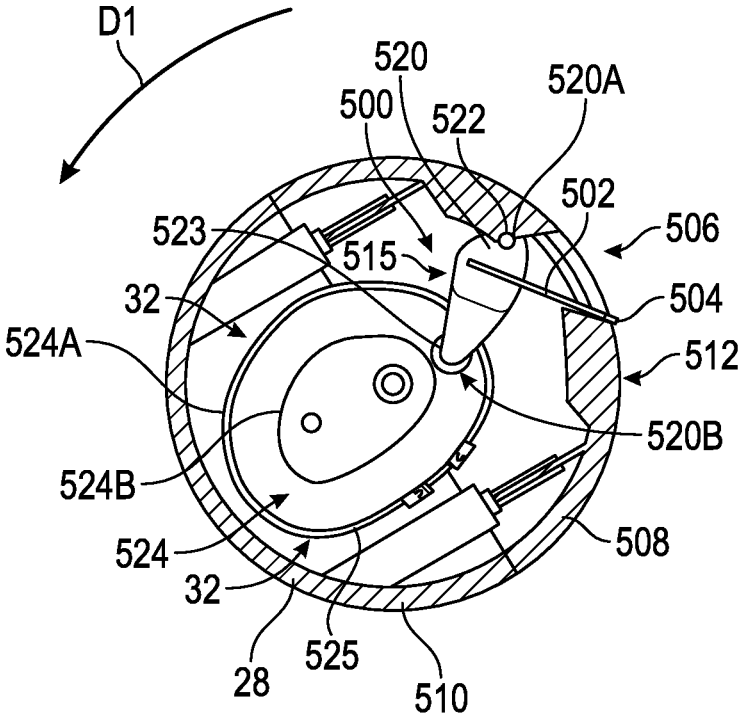
FIGS. 9A, 9B, and 9C show cross-sectional views illustrating the various positions of the cutting mechanism of FIGS. 8A and 8B.

FIGS. 8A-8B and 9A-9C illustrate a cutting assembly 500 according to an additional embodiment of the present disclosure, which cutting assembly 500 includes a cutting blade or portion 502 (e.g., having a plurality of spaced serrated or sharpened portions 504) that includes a linkage or similar structure that controls movement of the cutting blade 502. As shown in FIGS. 8A and 8B, the cutting blade 502 is received within a notch or recess 506 defined along an outer surface 508 of a cylindrical side wall 510 of the feed roller body 28, when the cutting blade 502 is in a retracted position 512 (as shown in FIGS. 8A, 8B, and 9A). The cutting blade 502 is moveable to an extended position 514 whereupon it at least partially projects from the notch/recess 506 of the feed roller body 28 to an extent sufficient to enable the blade 502 to engage the sheet material as it is dispensed to at least partially cut, score, or perforate a portion thereof.

The cutting assembly 500 also includes a linkage assembly 515 with a moveable support or body 520 that is connected to (or integrally formed with) and supports the cutting blade 502. A first end or portion 520A of the support 520 is rotatably, pivotably, or otherwise moveably connected to the feed roller body 28. In one example, the first end or portion 520A of the support 520 can include a pivotable or rotatable connection mechanism, such as a pinned or hinged connection 522, or other suitable connector for pivoting, rotation, or other movement thereabout. A second, free end 520B of the support 520 is attached to a cam follower 523, such as a roller, bearing, etc., that is received within and rides along a cam track 524 as the feed roller body 28 is rotated to dispense selected portions of the sheet material.

The cam track 524 is positioned/formed within selected positions of feed roller body 28, (e.g., within the interior cavity or chamber 32 thereof), and in one variation, the cam track 524 can be integrally formed with, or otherwise connected to, the bearings 470 supporting the feed roller body 28 and allowing rotation thereabout. In one embodiment, the cam track 524 can be defined in a track body or component 525 that is integrally formed with, or otherwise attached to, the bearing 470. In alternative constructions, the cam track 524 can be integrally formed with or otherwise defined in or along the feed roller body 28 or other portions attached thereto. As a result, as the feed roller is rotated to dispense the sheet material, the feed roller body 28 rotates about the cam track 524 moving the cam follower 523 therealong. As components of the cutting assembly 500 (e.g., the cam track 524) and the biasing assembly integrated with the feed roller body, e.g., housed within the feed roller body, tampering, damaging, unwanted access to, etc. of these components can be substantially minimized, inhibited, or prevented.

As additionally shown in FIGS. 8A-8B and 9A-9C, the cam track 524 is shaped, positioned, or otherwise configured such that the support 520 is rotated or pivots, moving the cutting blade between the retracted and extended positions 512 and 514, with rotation of the feed roller. For example, the cam track 524 has an outer surface 524A and an opposing inner surface 524B that contact or otherwise engage the cam member 523, and the cam track 524 controls/engages the cam follower 523 to engage and move the second end 520B of the support 520 towards and away from the wall 510 of the feed roller body 28 to pivot or otherwise move the support 520 about the rotatable connection mechanism 522 at its first end or portion 520A.

Figure 9B:
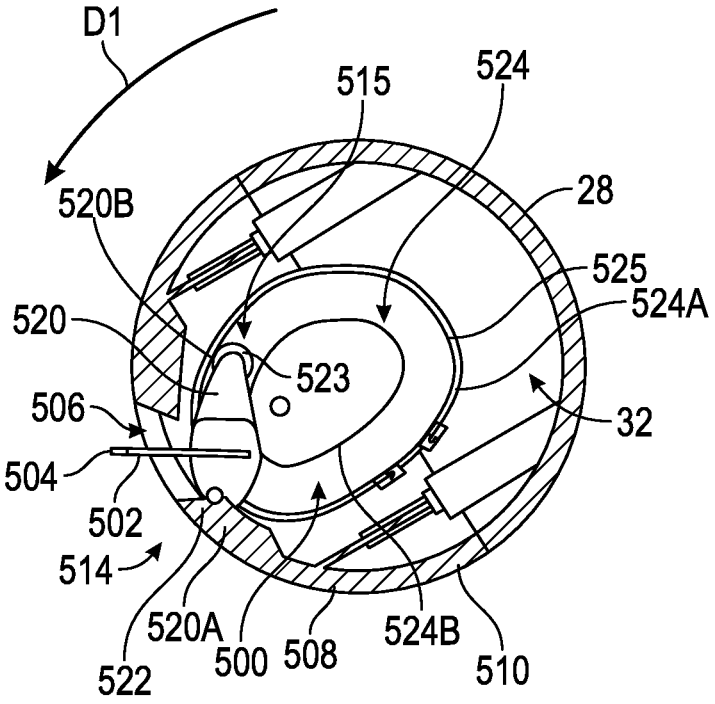
Figure 9C:
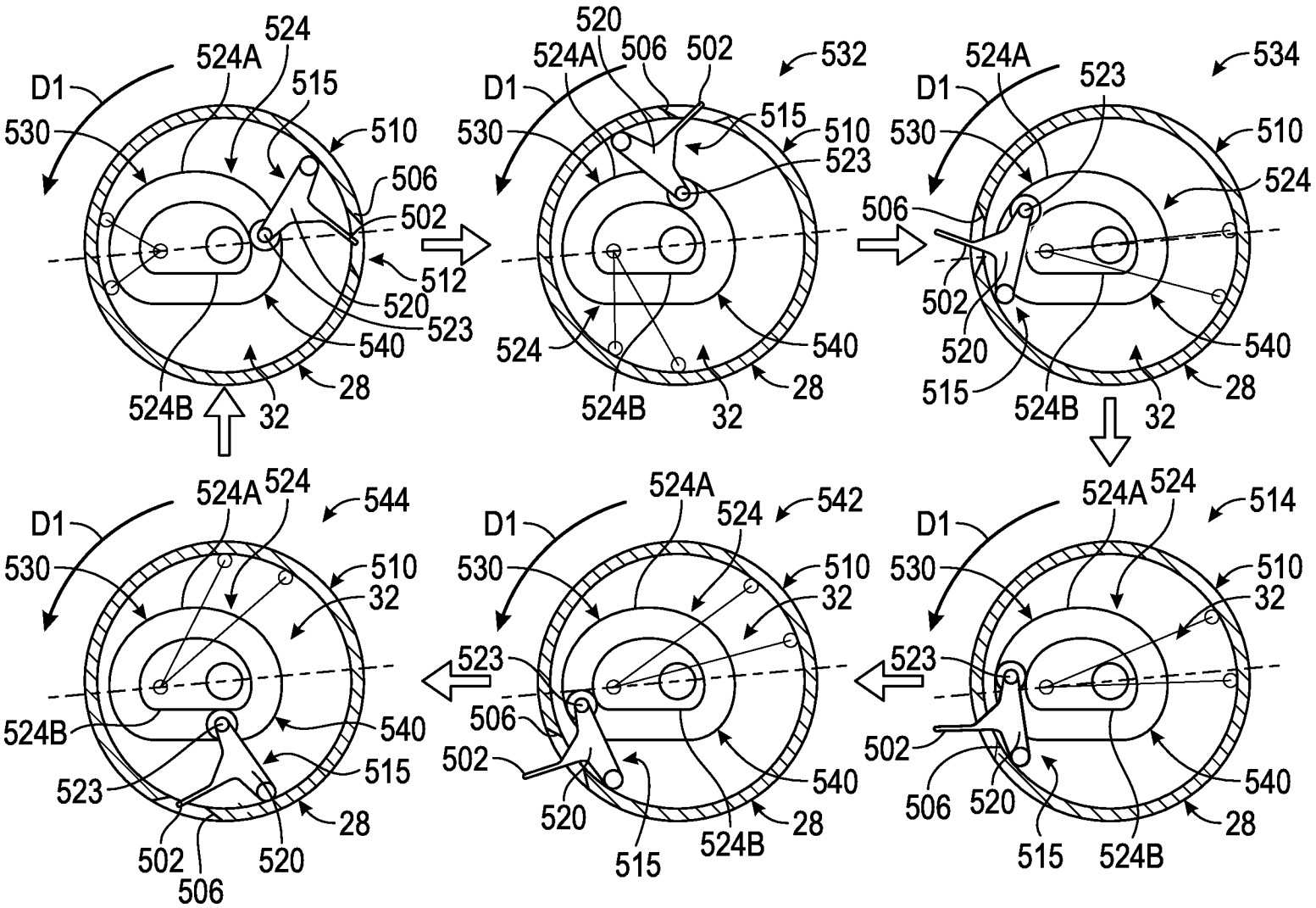

FIGS. 9A-9C illustrate cross-sectional views of the cutting assembly 500 and the feed roller body 28 showing movement of the cutting mechanism 500 between its initial, retracted or rest position 512 and its extended, cutting position 514 with rotation of the feed roller. FIG. 9A shows the cutting mechanism 500 in the initial, retracted position 512, FIG. 9B shows the cutting mechanism 500 in the extended, cutting position 514, while FIG. 9C illustrates movement of the cutting mechanism 500 across approximately 360 degree rotation of the feed roller body 28.

As shown in FIGS. 9A and 9C, in its retracted position 512, the cutting blade 502 is received within the notch or recess 506 and does not extend from the side wall 510 of the feed roller body 28 (e.g., such that sheet material can be received about the notch/recess without interference from the cutting blade). Then, as the feed roller body 28 is rotated (e.g., in the counterclockwise direction D1 shown in FIGS. 9A-9C) to dispense a selected amount of sheet material, the cam follower 523 will enter/engage a first portion 530 of the cam track 524, causing the cutting blade 502 to extend out from the notch 506 (at position 532). As the feed roller further rotates in the counterclockwise direction, the cam follower 523 further moves along/engages the first portion 530 of the cam track 524 to further extend the cutting blade 502 from the notch 506. The cam follower 523 will move along the first portion 530 of the cam track 524 with rotation of the feed roller body 28 until the cutting mechanism 502 is moved to its extended position 514 to substantially cut or perforate the sheet material as it is being dispensed, as generally shown in FIGS. 9B and 9C.

After the cutting blade 502 has reached its extended position (e.g., as shown at 514) and as the feed roller body 28 is continued to be rotated (e.g., under tension of the biasing assembly), the cam member 523 will begin to enter/engage a second portion 540 of the cam track 524 that facilitates return of the cutting blade 502 to its initial, retracted position 512 (e.g., as shown at 542). As the feed roller body 28 continues to rotate (e.g., under tension of the biasing assembly 450), the cutting blade 502 will return to its initial rest position 512 with the cutting mechanism 502 retracted within the notch 506.

FIGS. 9A-9C further show that the cam track 524 is shaped, positioned, and/or configured to move the second end 520B of support 520 to be in relatively closer proximity to the side wall 510 of the feed roller body 28 as the cutting blade 502 is moved toward its extended position (e.g., position 514). The track 524 further is shaped to move the second end 520B of the support 520 relatively further away from the side wall 510 of the feed roller body 28 to return the blade 502 to its retracted position 512. As a result, the cutting blade 502 is moved or driven by the linkage assembly 515, which movement can be controlled without requiring springs or other biasing members to return the blade 502 to the retracted position 512 (or to move the blade 502 to the extended position 514), e.g., enabling enhanced control and improved reliability, and/or cleaner cutting of the sheet material.

The cam track 524 further can be shaped, positioned, and/or configured such that the cutting blade 502 is in its extended position 514 (or other positions) at a selected or desired positions within the housing of the dispenser. For example, the cam track 524 may be shaped, positioned, and/or configured such that the cutting blade 502 only extends within the chamber of the housing, or does not extend at a position in which the cutting blade 502 would be exposed to users or maintenance personnel, e.g., to substantially prevent injury thereto or damage to the cutting blade.

Figure 10A:
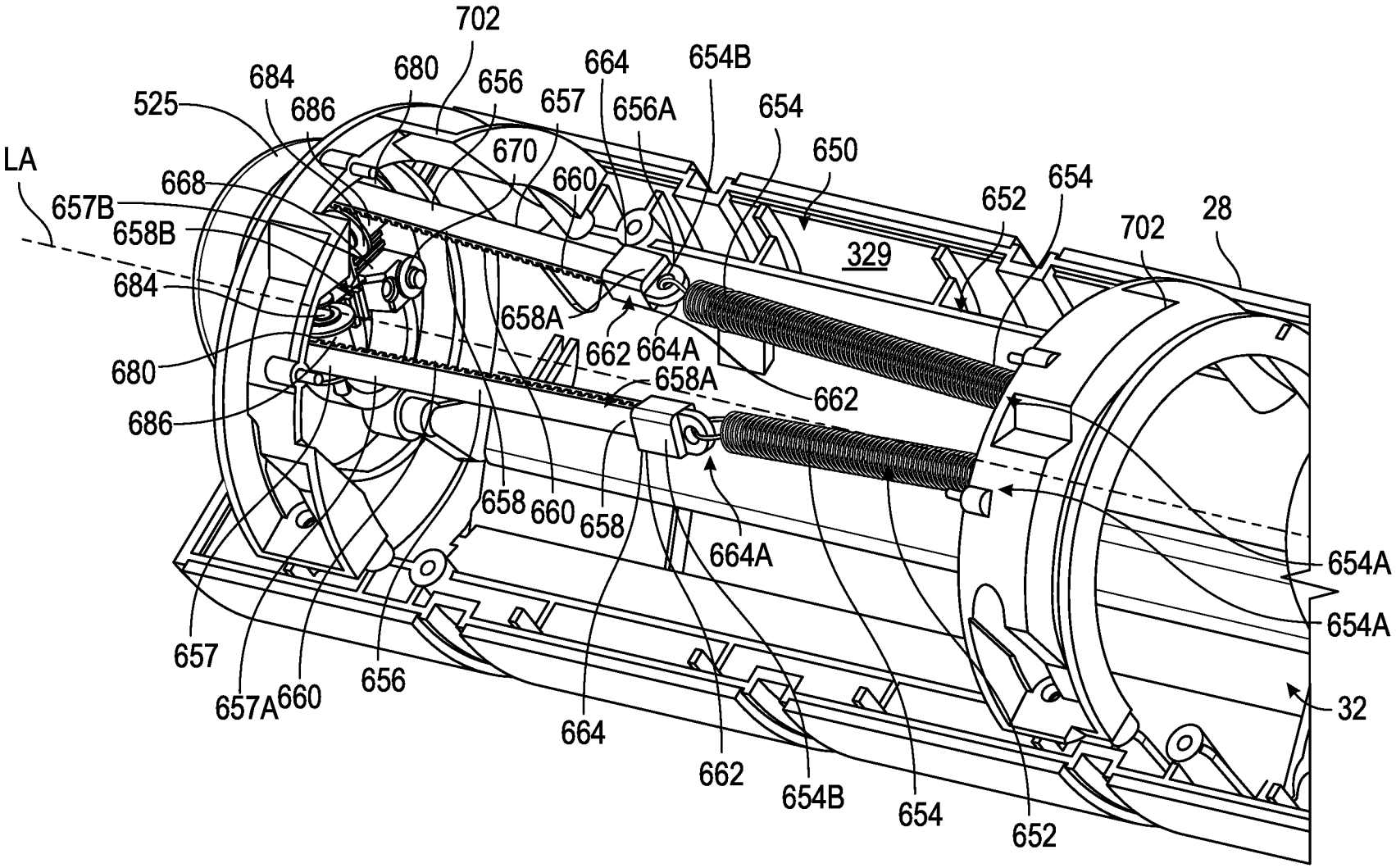
FIGS. 10A, 10B, and 10C show partial cutaway, perspectives view of a biasing assembly for controlling movement of a feed roller and/or cutting mechanism according to an additional aspect of the present disclosure.
Figure 10B:
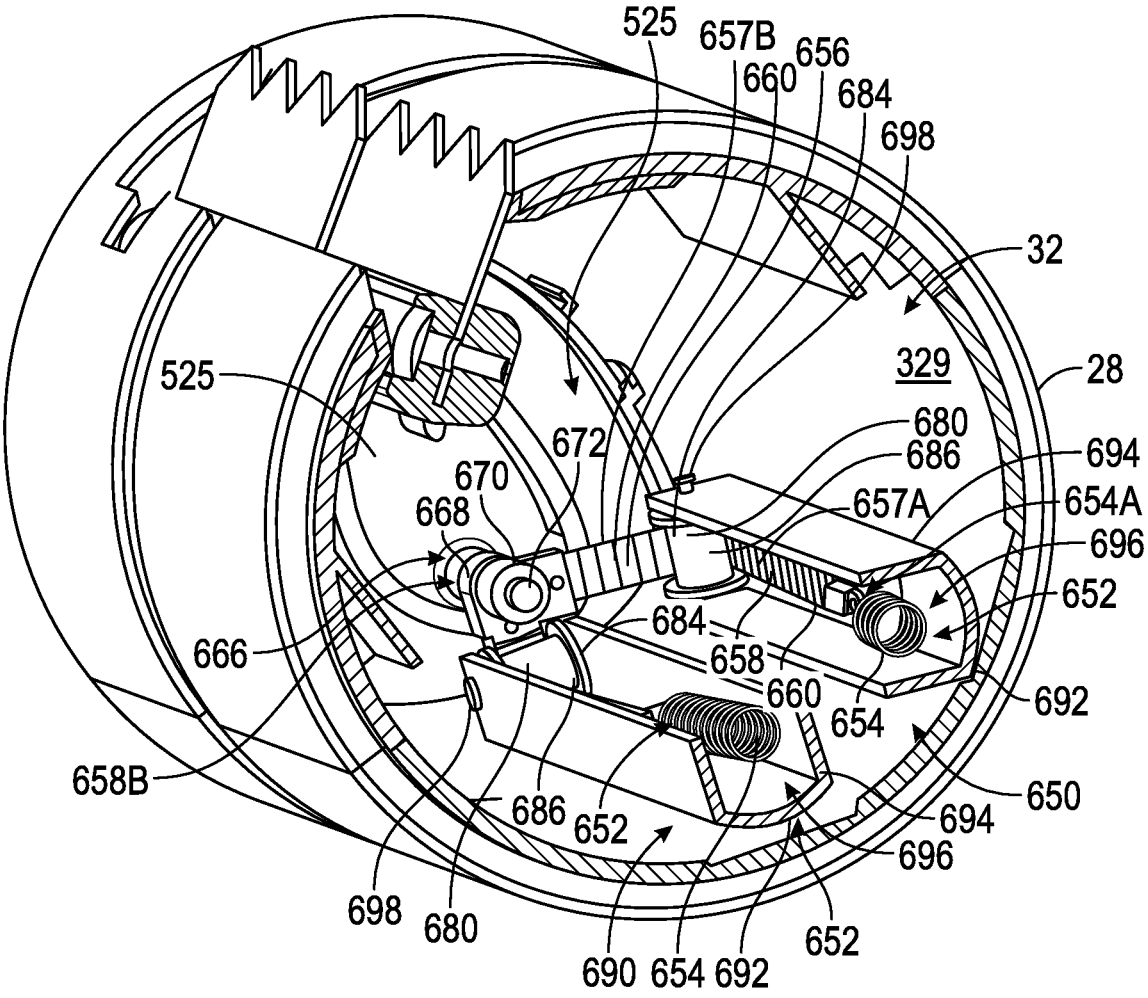
Figure 10C:
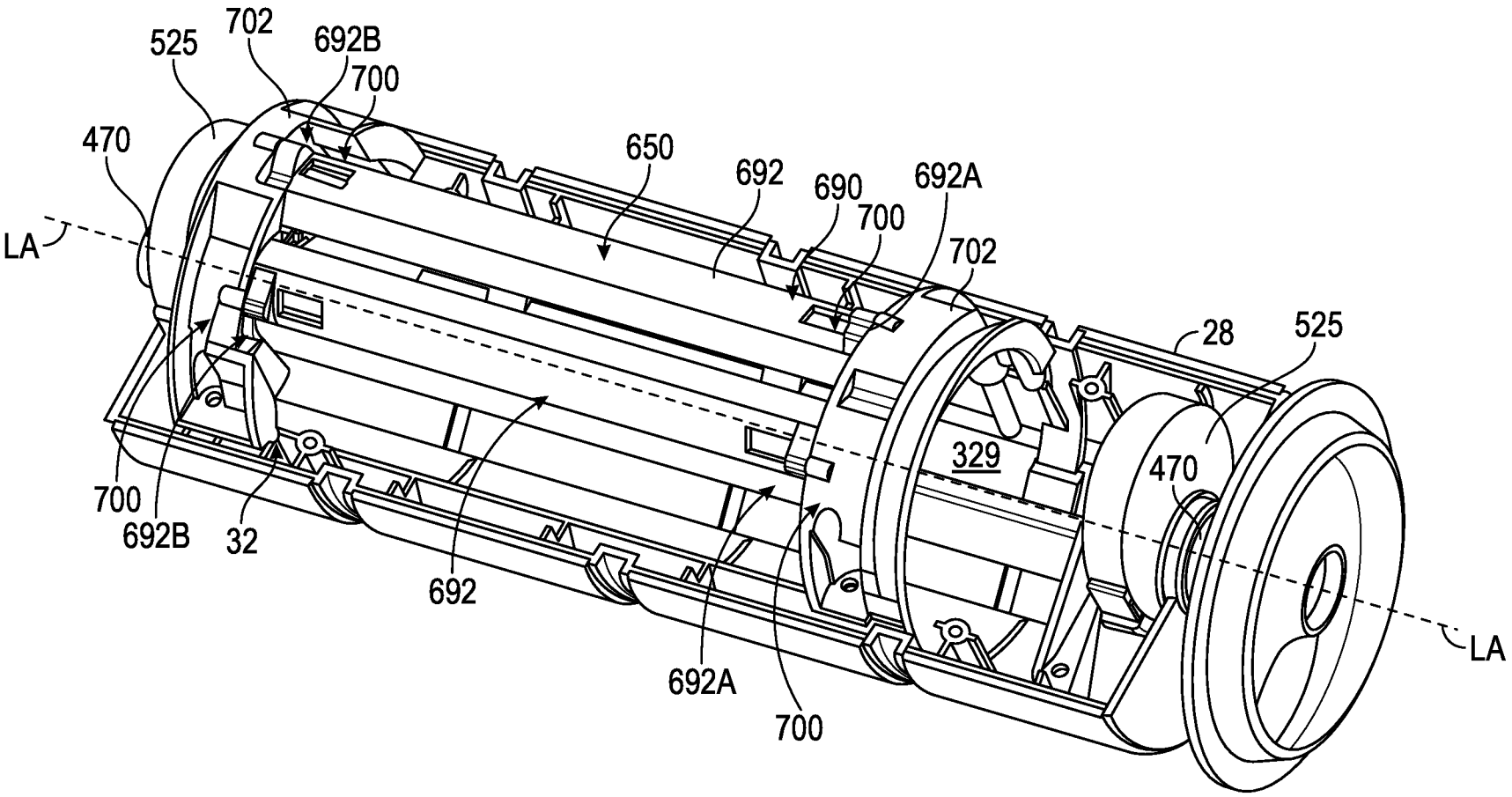

FIGS. 10A-10C illustrate a biasing assembly 650 according to yet another embodiment of the present disclosure. As shown in FIGS. 10A-10C, the biasing assembly 650 includes a plurality of biasing members 652, such as two or more biasing members 652, extending along the interior surface 329 of the feed roller body 28, e.g., in a direction that extends generally along the longitudinal (or rotational) axis (axis LA shown in FIGS. 10A and 10C) of the feed roller body 28. In one embodiment, the biasing members 652 can be generally parallel to the longitudinal axis LA; however, in other embodiments, the biasing members 652 can be set at an angle in relation to the longitudinal axis LA. The biasing members 652 can include tension springs with an elongated spring body 654 having first and second ends 654A/B, though other suitable tensioning or biasing members can be used without departing from the scope of the present disclosure. In one embodiment, one of the spring bodies 654 can have a length that is longer than another one of the spring bodies 654, though the spring bodies 654 can have generally the same length, without departing from the scope of the present disclosure.

As further illustrated in FIGS. 10A and 10B, the first end 654A of the biasing members 652 is connected to the feed roller body 28, and the second end 654B of the biasing members 652 is connected to a linkage 656. The linkage 656 is operatively connected to the bearing assembly 470, e.g., connected to the track body 525 formed therewith, or other suitable, fixed component that does not rotate with the feed roller body 28. The linkage 656 further generally includes a belt 657 having a belt body 658 with a plurality of cogs or teeth 660 or other suitable gripping projections extending along the belt body 658. The belt body 658 generally is formed from an elastomeric material, such as rubber, though the belt body 658 can be formed from other suitable materials, e.g., plastics or other polymeric materials, or combinations of materials, without departing from the scope of the present disclosure.

FIGS. 10A and 10B additionally show that the first end 656A of each linkage 656 can include a connector 662 having a connector body 664 that includes a looped or hooked end 664A that is connected to the second end 654B of a corresponding biasing member 454 (e.g., by a hook, hoop, or split-ring type of connection forming the second end 654B of the biasing member 654). The connector body 664 can be formed from a plastic or other suitable polymeric material, and further can be attached to the belt body 658 at a first end 658A thereof (e.g., by a fastener, adhesive, or other suitable fixing mechanism, such as, snap-fitting, frictional connection, etc.). The second end 656B of each linkage 656 can include a rotatable connection assembly 666 that is movably connected to the bearing assembly 470, e.g., to the track body 525 formed therewith. The rotatable connection assembly 666 can include a rotatable body 668 that is connected to the track body 525 by a pinned connection or other suitable connection that allows for rotational movement between the rotatable body 668 and the bearing assembly 470. In the illustrated embodiment, the rotatable body 668 includes a passage 670 defined therethrough that is sized and configured to receive a pin or axle 670 that is connected to the track body 525 and facilitates rotation of the rotatable body 668 relative thereto. The pin 670 can support the rotatable bodies 668 of the linkages 656 for each of the plurality of biasing members 652 in an adjacent series, e.g., the rotatable bodes 668 can be positioned next to or adjacent to each other along the pin 670, so as to be supported thereby. The rotatable body 668 further can be formed from a plastic or other suitable polymeric material, and can be fixed to a second end 658B of the belt body 658 (e.g., by a fastener, adhesive, or other suitable fixing mechanism, such as snap-fitting, frictional connection, etc.).

Additionally, the biasing assembly 650 can include one or more pulley assemblies 680 (as shown in FIGS. 10A and 10B) that engage and facilitate a change in the direction of the linkages 656 operatively connecting the biasing members 652 to the bearing assembly 470 or track body 525 (e.g., such that an axial pull force or tension along the biasing members 652 can be converted into a radial pull force or tension to maintain or assist in rotation of the feed roller body 28 and/or movement of the cutting mechanism). Each of the pulley assemblies 680 can include a pulley 684 having a track or race 686 against which at least a portion of the belt body 658 is engaged and/or moves. The pulley 684 can include a plurality of teeth or cogs (not shown) that correspond to an engage the cogs 660, such as to substantially reduce, inhibit, or prevent slippage or other disengagement between the pulley 684 and the belt body 658. Each pulley 687 further generally engages a corresponding belt 657 such that a first portion 657A of the belt 657 is generally aligned with its corresponding biasing member 652, e.g., extends in a direction along the longitudinal axis LA, and a second portion 657B of the belt 657 is generally arranged to be transverse to the biasing member 657, e.g., extends radially in relation to the feed roller body 28 or in a direction that otherwise transverse to the longitudinal axis LA of the feed roller body 28.

Accordingly, upon activation of the feed roller 28 (e.g., when a user pulls a hanging tab or portion of sheet material or turns a knob or lever connected to the feed roller), the feed roller body 28 rotates and carries the biasing assembly 650 therewith. As a result, the linkages 656 are caused to be pulled or otherwise engaged about the pulleys 684, tensioning and stretching the spring bodies of the biasing members 652, thus creating tension or force in or along the biasing members 652. This substantially linear force or tension can be translated into a rotational or radial tension force by the biasing assembly 650 to assist in the rotation of the feed roller and help urge the feed roller body 28 to return to its rest or home position. In one example, the rotation of the feed roller can be sufficient to generate a tab or portion for pulling or engagement by subsequent users for dispensing a selected portion of sheet material. Also, this tension helps facilitate rotation of the feed roller body 28 sufficient to cause activation or movement of the cutting blade of the dispenser to cut, perforate, or otherwise cause or assist in separation of a sheet of the paper material. The return movement of the feed roller body 28 also can cause retraction of the cutting blade (e.g., into the notch, recess, opening, etc. in the feed roller body).

FIGS. 10B and 10C further indicate that the biasing assembly 650 can include a support assembly 690 that is configured to support the biasing members 652, linkages 656, and pulleys 684 along the feed roller body 28, e.g., to help facilitate alignment of, or to help to substantially reduce, prevent, or inhibit misalignment of, the biasing members 652, linkages 656, and/or pulleys 684 when the biasing assembly 650 is rotated or otherwise moved with the feed roller body 28. As shown in FIGS. 10B and 10C, the support assembly 690 can include brackets or other suitable supports 692 corresponding to each of the biasing members 652. The brackets 692 can include an elongated bracket body 694 with a passage or channel 696 defined therealong that receives corresponding biasing members 652, linkages 656, and pulleys 684. The brackets 692 can support and/or engage the biasing members 652, linkages 656, and pulleys 684 such that the biasing members 652, linkages 656, and pulleys 684 move substantially in unison with each other, e.g., as a unit, to reduce, inhibit, or prevent dislocation or misalignment thereof during rotation or other movements of the feed roller body 28.

The bracket body 694 can be formed from a plastic or other polymeric material, though other suitable materials, such as materials sufficient rigidity to help to facilitate alignment of the biasing members 652, linkages 656, and/or pulleys 684 can be used without departing from the scope of the present disclosure. The biasing members 652 can be connected to a first end 692A of the bracket body 692 (e.g., a hooked or looped end of the springs 654 can be connected to a rod, pin, or other fastener, such as a screw, bolt, etc., that is attached to the bracket body 625). The pulleys 684 can be connected to a second end 692A of the bracket body 692. In the illustrated embodiment shown in FIG. 10B, the pulleys 684 are connected to the bracket body 692 by a pin or rod 698 that allows for rotation or pivoting of the pulleys 684 thereabout.

As additionally indicated in FIG. 10C, the brackets 692 can be pivotably or rotatably mounted (e.g., by a pinned or hinged connection 700) to the interior surface 329 of the feed roller body 28. The pinned or hinged connection 700 can help to maintain engagement between, or substantially prevent misalignment of, the biasing members 652, linkages 656, and/or pulleys 684 as/when the feed roller body 28 is rotated. FIG. 10C shows that the brackets 692 are connected to the feed roller body 28 at the first and second ends 692A and 692B thereof by corresponding pinned connections 700. For example, the pinned connections 700 can allow for some give or movement of the brackets 692 and the supported biasing members 652, linkages 656, and/or pulleys 684 in relation to the feed roller body during rotation thereof for dampening of accelerations, vibrations, etc. and substantially reducing, inhibiting, or preventing dislocation or misalignment thereof.

In the embodiment illustrated in FIGS. 10A and 10C, the support assembly 690 also includes bearing supports 702 that support and connect the brackets 692 to the feed roller body 28. That is, the brackets 692 can be connected to the bearing supports 702 by the pinned connection 700, and the bearing supports 702 can be connected to the feed roller body 28 (e.g., the bearing supports 702 can be connection to the feed roller body 28 by fasteners, such as screws, bolts, etc. though the bearing supports 702 can be otherwise connected to the feed roller body 28, such as by an adhesive, snap-fitting, or other suitable attachment mechanism, without departing from the scope of the present disclosure). The bearing supports 702 generally can include a bearing support body 704 that includes a generally arcuate, curved, or cylindrical shape and is sized and/or otherwise configured to generally conform to or be complementary to the interior surface 329 of the feed roller body 28. The bearing support body 704 further can be formed from a plastic or polymeric material, though other suitable materials, e.g., other synthetic or composite materials, can be used without departing from the scope of the present disclosure. The interior surface 329 of the feed roller body 28 further can have a notches or recessed portions 706 formed/defined therein to accommodate movement/pivoting of the brackets 692 about the pinned connection 700. Furthermore, it will be understood that the bearing supports 702 can be omitted and the brackets 692 can be directly or otherwise connected to the feed roller body 28, without departing from the scope of the present disclosure.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A sheet material dispenser, comprising:

a dispenser housing with a supply of sheet material supported therein;

a feed roller rotatably mounted within the dispenser housing, and including a feed roller body having a chamber defined therein, and an exterior surface that at least partially engages the sheet material for feeding or dispensing of the sheet material along a path of travel from the supply of sheet material toward a discharge;

one or more pressing rollers biased toward the feed roller sufficient to engage the sheet material between the one or more pressing rollers and the feed roller so that the sheet material is pulled from the supply and fed along the path of travel upon rotation of the feed roller;

a cutting assembly at least partially disposed within the chamber defined in the feed roller body, and including a cutting blade and at least one movable support coupled to cutting blade and the feed roller body, the cutting blade being actuated with rotation of the feed roller so as to move through one or more openings defined along the feed roller body to at least partially cut, score, or perforate the sheet material during dispensing of a selected portion thereof; and a biasing assembly coupled to the feed roller body to assist rotation of the feed roller and/or movement of the cutting blade through the one or more openings;

wherein the biasing assembly comprises a biasing member extending along a rotational axis of the feed roller body.

2. The sheet material dispenser of claim 1, wherein the cutting assembly further includes a cam follower connected to the at least one moveable support, and which engages and rides along a cam surface or track within the chamber of the feed roller body as the feed roller is rotated to cause movement of the cutting blade through the one or more openings in the body of the feed roller.

3. The sheet material dispenser of claim 2, wherein the cam surface or track is mounted within the chamber of the feed roller body such that the feed roller and the cutting blade are rotatable thereabout.

4. The sheet material dispenser of claim 1, wherein the at least one moveable support is rotatably fixed to an interior surface of the feed roller body at a first end thereof and to a cam follower at a second, free end thereof, such that as the feed roller is rotated, the cam follower moves about and engages a cam surface or track to pivot the at least one moveable support about the first end thereof connected to the feed roller body and move the cutting blade toward engagement with the sheet material.

5. The sheet material dispenser of claim 1, wherein the biasing assembly further comprises:

a linkage having one end connected to the biasing member and an opposing end connected to a component of the sheet material dispenser that is substantially fixed in relation to the feed roller body; and a pulley configured to engage the linkage to facilitate a change of direction thereof, wherein an axial pulling force or tension directed along the biasing member is converted into a radial pulling force or tension to assist in rotation of the feed roller body, and/or to facilitate movement of the cutting blade through the one or more openings for at least partially cutting or perforating the selected portion of the sheet material.

6. The sheet material dispenser of claim 1, wherein the pulley engages the linkage such that a first portion of the linkage extends along the rotational axis of the feed roller body, and a second portion of the linkage extends transverse to the rotational axis of the feed roller body.

7. The sheet material dispenser of claim 1, wherein the linkage includes a wire, band, belt, or rod.

8. The sheet material dispenser of claim 1, wherein the biasing assembly further comprises a bracket that supports the pulley, the biasing member, and/or the linkage, the bracket movably connected to an interior surface of the feed roller body to inhibit misalignment of the biasing member, the linkage, and/or the pulley.

9. The sheet material dispenser of claim 1, wherein the component of the dispenser comprises a bearing that is connected to the dispenser housing and at least partially engages and supports the feed roller body.

10. A sheet material dispenser, comprising:

a dispenser housing with a supply of sheet material supported therein and a discharge through which the sheet material is dispensed;

a feed roller rotatably mounted within the dispenser housing, and including a feed roller body having a chamber defined therein, and an exterior surface that at least partially engages the sheet material for feeding or dispensing thereof along a path of travel of the sheet material towards the discharge of the dispenser housing;

a cutting assembly disposed within the chamber of the feed roller body and including a cutting blade and a linkage connected to the cutting blade, the linkage being connected to an interior surface of the feed roller body at a first end and to a cam follower at a second end, wherein as the feed roller body rotates the cam follower moves about and engages a cam track defined within the chamber of the feed roller body, the linkage is pivoted about the first end thereof to move the cutting blade toward engagement with the sheet material; and a biasing assembly including one or more biasing members coupled to the feed roller body to assist rotation thereof and/or facilitate movement of the cutting blade.

11. The sheet material dispenser of claim 10, further comprising one or more pressing rollers positioned adjacent the feed roller body, and biased toward the feed roller body sufficient to engage the sheet material between the one or more pressing rollers and the feed roller body so that the sheet material is pulled therebetween and from the supply for feeding along the path of travel upon rotation of the feed roller.

12. The sheet material dispenser of claim 10, wherein the plurality of biasing members generally extend along a rotational axis of the feed roller body.

13. The sheet material dispenser of claim 10, wherein the biasing assembly further comprises:

one or more linkages, each linkage of the one or more linkages including one end that is connected to a corresponding biasing member of the one or more biasing members; and one or more of pulleys, each configured to engage a corresponding linkage of one or more linkages to facilitate a change of direction thereof, wherein an axial pulling force or tension along the one or more biasing members is converted into a radial pulling force or tension to assist in rotation of the feed roller and/or facilitate movement of the cutting blade.

14. The sheet material dispenser of claim 13, wherein the biasing assembly further comprises one or more brackets each supporting a corresponding pulley of the one or more pulleys, each of the one or more brackets pivotally connected to an interior surface of the feed roller body to help to inhibit misalignment of the one or more biasing members, the one or more linkages, and/or the one or more pulleys.

15. The sheet material dispenser of claim 13, further comprising a bearing coupled to the dispenser housing and rotationally supporting the feed roller body, the cam track defined along a component in communication with the bearing, and each linkage of the one or more linkages being rotatably connected to the component.

* * * * *